US009946178B2

(12) United States Patent
Kadokura et al.

(10) Patent No.: US 9,946,178 B2
(45) Date of Patent: Apr. 17, 2018

(54) TONER FOR ELECTROSTATIC IMAGE DEVELOPMENT, ELECTROSTATIC IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Yasuo Kadokura, Kanagawa (JP); Hiroyoshi Okuno, Kanagawa (JP); Satoshi Inoue, Kanagawa (JP); Yoshifumi Iida, Kanagawa (JP); Tomohito Nakajima, Kanagawa (JP); Yuka Zenitani, Kanagawa (JP); Yoshifumi Eri, Kanagawa (JP); Yasuhisa Morooka, Kanagawa (JP); Shunsuke Nozaki, Tokyo (JP); Takeshi Iwanaga, Kanagawa (JP); Sakae Takeuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/218,345

(22) Filed: Jul. 25, 2016

(65) Prior Publication Data

US 2017/0227869 A1 Aug. 10, 2017

(30) Foreign Application Priority Data

Feb. 10, 2016 (JP) ..... 2016-024122

(51) Int. Cl.

| | |
|---|---|
| ***G03G 9/097*** | (2006.01) |
| ***G03G 9/087*** | (2006.01) |
| ***G03G 15/08*** | (2006.01) |
| ***G03G 9/08*** | (2006.01) |
| ***G03G 9/113*** | (2006.01) |

(52) U.S. Cl.

CPC ..... *G03G 9/08755* (2013.01); *G03G 9/0819* (2013.01); *G03G 9/0827* (2013.01); *G03G 9/08782* (2013.01); *G03G 9/08795* (2013.01); *G03G 9/08797* (2013.01); *G03G 9/09725* (2013.01); *G03G 9/09766* (2013.01); *G03G 9/1139* (2013.01); *G03G 15/0865* (2013.01)

(58) Field of Classification Search

CPC ..... G03G 9/09708; G03G 9/09716; G03G 9/09733; G03G 9/09766; G03G 9/09725

See application file for complete search history.

(56) References Cited

U.S. PATENT DOCUMENTS

| | | | | |
|---|---|---|---|---|
| 2011/0065035 | A1* | 3/2011 | Anno | G03G 9/0821 430/105 |
| 2012/0237864 | A1* | 9/2012 | Saito | G03G 9/09725 430/105 |
| 2013/0071781 | A1* | 3/2013 | Saito | G03G 9/0812 430/105 |
| 2013/0196259 | A1* | 8/2013 | Iida | G03G 9/0804 430/105 |
| 2016/0139521 | A1* | 5/2016 | Tsuda | G03G 9/0827 430/108.7 |

FOREIGN PATENT DOCUMENTS

| | | |
|---|---|---|
| JP | 2003-167381 A | 6/2003 |
| JP | 2011-059586 A | 3/2011 |

* cited by examiner

*Primary Examiner* — Hoa V Le
(74) *Attorney, Agent, or Firm* — Oliff PLC

(57) ABSTRACT

A toner for electrostatic image development includes toner particles; and an external additive containing silica particles and polytetrafluorethylene particles, the silica particles having a compression-aggregation degree of 60% or more and 95% or less and a particle compression ratio of 0.20 or more and 0.40 or less.

19 Claims, 2 Drawing Sheets

TONER FOR ELECTROSTATIC IMAGE DEVELOPMENT, ELECTROSTATIC IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2016-024122 filed Feb. 10, 2016.

BACKGROUND (i) Technical Field

The present invention relates to a toner for electrostatic image development, an electrostatic image developer, a toner cartridge, a process cartridge, an image forming apparatus, and an image forming method.

(ii) Related Art

A method for visualizing image information through electrostatic images by an electrophotographic method is currently used in various fields. The electrophotographic method includes forming, by charging and exposure, an electrostatic image of image information on the surface of an image holding member and developing a toner image on the surface of the photoreceptor with a developer containing a toner, transferring the toner image to a recording medium such as paper, and further fixing the toner image to the surface of the recording medium to visualize as an image.

SUMMARY

In an electrophotographic process, an external additive is dammed at the end (the downstream part in the rotational direction) of a contact part (hereinafter referred to as a "cleaning part") between a cleaning blade and an image holding member (hereinafter referred to as a "photoreceptor"). Thus, an aggregate (hereinafter referred to as an "external additive mass") is formed due to aggregation by the pressure applied from the cleaning blade. Polytetrafluoroethylene (PTFE) particles used as an external additive are easily crushed and adhered to other additives and have lubricity. The PTFE particles are crushed in the external additive mass by the nip pressure of the cleaning blade in the cleaning part, and thus there is the effect of increasing dam strength and increasing lubricity due to adhesion of external additives contained in the external additive mass. This is important for suppressing wearing of the cleaning blade.

However, the PTFE particles easily adhere to the surface of the photoreceptor, and particularly when a solid image is formed by consuming a large amount of toner, there is the problem of causing image deletion and an image defects due to the image deletion.

According to an aspect of the present invention, there is provided a toner for electrostatic image development including toner particles and an external additive containing silica particles and polytetrafluoroethylene particles, the silica particles having a compression-aggregation degree of 60% or more and 95% or less and a particle compression ratio of 0.20 or more and 0.40 or less.

BRIEF DESCRIPTION OF THE DRAWINGS

Exemplary embodiments of the present invention will be described in detail based on the following figures, wherein.

DETAILED DESCRIPTION

Figure 1:
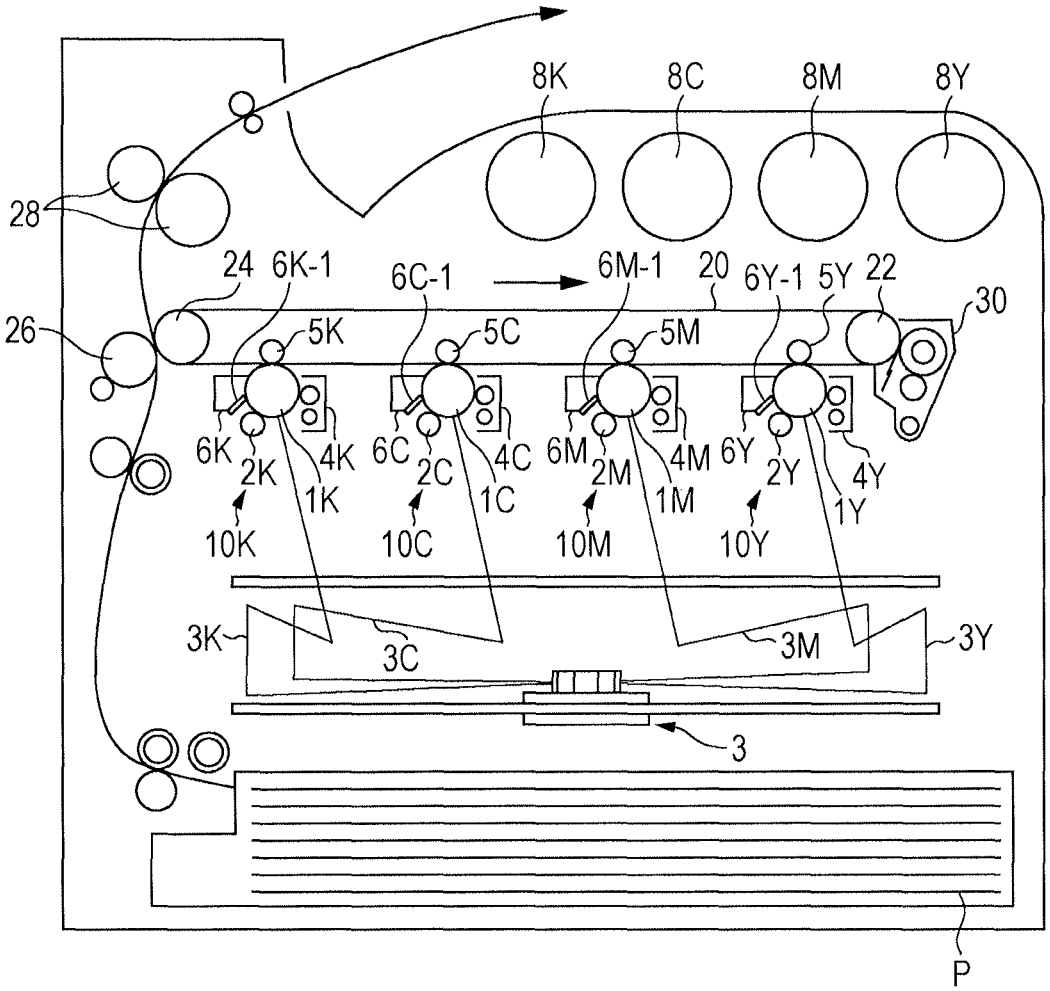
FIG. 1 is a schematic configuration diagram showing an example of an image forming apparatus according to an exemplary embodiment of the present invention.

Exemplary embodiments of the present invention are described below.

<Toner for Electrostatic Image Development>

A toner for electrostatic image development (hereinafter referred to as a "toner") according to an exemplary embodiment of the present invention includes toner particles and an external additive containing silica particles (hereinafter also referred to as "specific silica particles") and PTFE particles, the silica particles having a compression-aggregation degree of 60% or more and 95% or less and a particle compression ratio of 0.20 or more and 0.40 or less.

In general, the flowability of a toner containing toner particles and silica particles externally added thereto may be decreased by a change in an external addition structure of the silica particles (the state of adhesion of the silica particles to toner particles) in the toner, thereby decreasing charge retentivity. An example of the cause of a change in the external addition structure is that the silica particles are moved and localized on the toner particles and the silica particles are separated from the toner particles. In particular, in the use of the toner particles having an average circularity of as high as 0.98 or more and 1.00 or less and a shape close to a spherical shape, the silica particles are easily moved on the toner particles and separated from the toner particles, and thus a change in external addition structure easily occurs.

Also, when the toner particles having an average circularity of as high as 0.98 or more and 1.00 or less and a shape close to a spherical shape are used, the toner particles easily slip through a cleaning blade during repeated formation of the same image. The toner particles having a shape close to a spherical shape have a nearly smooth surface and are hardly scraped by a cleaning part (a contact part between the cleaning blade and the photoreceptor (image holding member)). Therefore, when a large amount of the toner particles reach the same region of the cleaning part during repeated formation of the same image, the toner particles easily slip through the cleaning blade.

Meanwhile, the silica particles externally added to the toner particles may be separated from the toner particles by the mechanical load due to stirring in a development unit, scraping by the cleaning part, or the like. When the separated silica particles reach the cleaning part, the silica particles are dammed at the end (the downstream part of the contact part between the cleaning blade and the image holding member in the rotational direction) of the cleaning part, and an aggregate (hereinafter referred to as an "external additive mass") is formed due to aggregation by the pressure applied from the cleaning blade. The external additive mass contributes to an improvement in cleaning properties.

Also, when PTFE particles are used as an external additive in combination with the silica particles, the PTFE particles may be separated from the silica particles. Also, when the separated PTFE particles reach the cleaning part, the PTFE particles may be dammed at the end of the cleaning part and may partially constitute the external additive mass. The PTFE particles are easily crushed and adhered as compared with the silica particles, and thus the silica particles are bonded to each other by the PTFE particles, thereby increasing the strength of the external additive mass. Therefore, the cleaning properties are improved, and wearing of the cleaning blade is suppressed due to excellent lubricity of the PTFE particles.

However, the PTFE particles easily adhere to the surface of the photoreceptor, and particularly when a solid image is formed by consuming a large amount of toner, the PTFE particles easily adhere to the surface of the photoreceptor, and an image defect may occur due to image deletion. The occurrence of image deletion is supposed to be due to the adhesion of a discharge product to the PTFE particles adhering to the surface of the photoreceptor.

Further, when the toner particles slip through, a large amount of the silica particles (silica particles in the external additive mass) dammed by the cleaning part may also slip through, and thus claw may occur on the photoreceptor due to the silica particles. The claw on the photoreceptor is considered to be due to rubbing of the photoreceptor when the silica particles slip through the cleaning blade.

When the toner according to the exemplary embodiment contains the specific silica particles and PTFE particles external added to the toner particles, the occurrence of image deletion is suppressed. Although the reason for this is unclear, the reason is supposed as follows.

The specific silica particles satisfying the compression-aggregation degree and the particle compression ratio within the ranges described above are silica particles having the properties of high flowability, high dispersibility in the toner particles, high aggregation property, and high adhesion to the toner particles.

Silica particles generally have high flowability but a low bulk density, and thus have low adhesion and the low aggregation property.

Meanwhile, for the purpose of enhancing the flowability of silica particles and dispersibility in the toner particles, there is known a technique of treating the surfaces of the silica particles with a hydrophobizing agent. The technique improves the flowability of the silica particles and dispersibility in the toner particles, but the aggregation property remains low.

There is also known a technique of treating the surfaces of the silica particles with both the hydrophobizing agent and silicone oil. This technique improves the adhesion to the toner particles and improves the aggregation property. However, conversely, the flowability and dispersibility in the toner particles are easily decreased.

That is, it is said that the flowability of the silica particles and the dispersibility in the toner particles have a contrary relationship to the aggregation property and the adhesion to the toner particles.

However, as described above, the specific silica particles satisfying the compression-aggregation degree and the particle compression ratio within the ranges described above are improved in four properties, such as flowability, dispersibility in the toner particles, the aggregation property, and adhesion to the toner particles.

Next, the meanings for controlling the compression-aggregation degree and the particle compression ratio of the specific silica particles within the ranges described above are described in order.

First, the meaning for controlling the compression-aggregation degree of the specific silica particles to 60% or more and 95% or less is described.

The compression-aggregation degree is an index which indicates the aggregation property of the silica particles and the adhesion to the toner particles. The index is shown by the degree of difficulty of disintegration of a silica particle compact when the silica particle compact is formed by compressing silica particles and is then dropped.

Therefore, there is a tendency that as the compression-aggregation degree increases, the bulk density of the silica particles easily increases and cohesive force (intermolecular force) increases, and the adhesion to the toner particles increases. A method for calculating the compression-aggregation degree is described in detail later.

Thus, the specific silica particles with the compression-aggregation degree controlled to be as high as 60% or more and 95% or less have good adhesion to the toner particles and good aggregation property. However, the upper limit of the compression-aggregation degree is 95% from the viewpoint of securing flowability and dispersibility in the toner particles while maintaining good adhesion to the toner particles and good aggregation property.

Next the meaning for controlling the particle compression ratio of the specific silica particles to 0.20 or more and 0.40 or less is described.

The particle compression ratio is an index indicating the flowability of the silica particles. Specifically, the particle compression ratio is shown by a ratio of a difference between the packed apparent specific gravity and loose apparent specific gravity of the silica particles to the packed apparent specific gravity ((packed apparent specific gravity−loose apparent specific gravity)/(packed apparent specific gravity)).

Thus, it is shown that the lower the particle compression ratio, the higher the flowability of the silica particles. Also, there is a tendency that as the flowability increases, the dispersibility in the toner particles also increases. A method for calculating the particle compression ratio is described in detail later.

Thus, the specific silica particles with the particle compression ratio controlled to be as low as 0.20 or more and 0.40 or less have good flowability and good dispersibility in the toner particles. However, the lower limit of the particle compression ratio is 0.20 from the viewpoint of improving the adhesion to the toner particles and the aggregation property while maintaining good flowability and dispersibility in the toner particles.

According to the above, the specific silica particles have the peculiar properties of high flowability, high dispersibility in the toner particles, the high cohesive force, and high adhesion to the toner particles. Therefore, the specific silica particles satisfying the compression-aggregation degree and particle compression ratio within the ranges described above have the properties of high flowability, high dispersibility in the toner particles, the high aggregation property, and high adhesion to the toner particles.

Next, the estimated function of the specific silica particles and the PTFE particles externally added to the toner particles is described.

First, the specific silica particles have high flowability and high dispersibility in the toner particles, and thus when externally added to the toner particles, the specific silica particles easily adhere in a nearly uniform state to the surfaces of the toner particles. Thus, once the specific silica particles have adhered to the toner particles, the specific silica particles are hardly moved on the toner particles and separated from the toner particles by the mechanical load due to stirring or the like in the development unit because of the high adhesion to the toner particles. That is, a change in the external addition structure little occurs. Therefore, the flowability of the toner particles is increased, and the high flowability is easily maintained. Consequently, a change in the external addition structure easily occurs, and a decrease in charge retentivity is suppressed even when the toner particles close to spherical toner particles are used.

Meanwhile, the specific silica particles which are separated from the toner particles by mechanical load due to scraping by the cleaning part and are supplied to the end of the cleaning part have the high aggregation property and thus form a strong external additive mass due to aggregation by the pressure applied from the cleaning blade. Further, when the specific silica particles are externally added in combination with the PTFE particles, the strength of the strong external additive mass formed by the specific silica particles is further improved. Therefore, the cleaning properties by the strong external additive mass are further increased, and the PTFE particles adhering to the surface of the photoreceptor are easily removed. Consequently, the occurrence of image deletion is suppressed.

Further, the cleaning properties are further improved due to the strong external additive mass, and even when a large amount of nearly spherical toner particles reach the same region of the cleaning part during repeated formation of the same image, slipping of the toner particles is suppressed. Consequently, slipping of a large amount of the silica particles (silica particles of the external additive mass), which is caused by slipping of the toner particles, is also suppressed, and thus the occurrence of claw on the photoreceptor is suppressed.

Therefore, the toner according to the exemplary embodiment is supposed to suppress the occurrence of image deletion. Further, when the same image is repeatedly formed, the occurrence of claw on the photoreceptor is supposed to be suppressed.

In the toner according to the exemplary embodiment of the present invention, the specific silica particles preferably further have a degree of particle dispersion of 90% or more and 100% or less.

The meaning for controlling the degree of particle dispersion of the specific silica particles to 90% or more and 90% or less is described.

The degree of particle dispersion is an index indicating the dispersibility of silica particles. The index is shown by the degree of ease of dispersion of the silica particles in a primary particle state in the toner particles. Specifically, the degree of particle dispersion is shown by a ratio (measured coverage C/calculated coverage $C_o$) of measured coverage C of an adhesion object to calculated coverage $C_o$ wherein $C_o$ is the calculated coverage of toner particle surfaces with the silica particles, and C is the measured coverage.

Therefore, it is shown that the higher the degree of particle dispersion is, the more hardly the silica particles are aggregated, and the more easily the silica particles in the primary particle state are dispersed in the toner particles. A method for calculating the degree of particle dispersion is described in detail later.

The dispersibility of the specific silica particles in the toner particles is further improved by controlling the degree of particle dispersion to be as high as 90% or more and 100% or less while controlling the compression-aggregation degree and the particle compression ratio within the ranges described above. Thus, the flowability of the toner particles is further enhanced, and the high flowability is easily maintained. Consequently, the specific silica particles easily adhere in a nearly uniform state to the surfaces of the toner particles, and a decrease in charge retentivity is easily suppressed.

In the toner according to the exemplary embodiment of the present invention, as described above, the specific silica particles having the properties of high flowability, high dispersibility in the toner particles, the high aggregation property, and high adhesion to the toner particles are preferably silica particles with surfaces to which a siloxane compound having a relatively high weight-average molecular weight adheres. Specifically, the specific silica particles preferably have surfaces to which a siloxane compound having a viscosity of 1,000 cSt or more and 50,000 cSt or less adheres (the amount of surface adhesion is preferably 0.01% by mass or more and 5% by mass or less). The specific silica particles are produced by a method of surface-treating the surfaces of the silica particles with a siloxane compound having a viscosity of 1,000 cSt or more and 50,000 cSt or less so that the amount of surface adhesion is 0.01% by mass or more and 5% by mass or less.

The amount of surface adhesion is shown by a ratio to the silica particles (untreated silica particles) before the surface treatment of the surfaces of the silica particles. Hereinafter, the silica particles (that is, untreated silica particles) before the surface treatment are simply referred to as "silica particles".

The specific silica particles surface-treated with a siloxane compound having a viscosity of 1,000 cSt or more and 50,000 cSt or less so that the amount of surface adhesion is 0.01% by mass or more and 5% by mass or less are increased in flowability and dispersibility in the toner particles and also in the aggregation property and adhesion to the toner particles, and thus the compression-aggregation degree and the particle compression ratio easily satisfy the requirements described above. In addition, a decrease in charge retentivity and the occurrence of image deletion are easily suppressed. The reason for this is not clear, but the conceivable reason is as follows.

When a siloxane compound having relatively high viscosity within the range described above is adhered in a small amount within the range described above to the surfaces of the silica particles, the function derived from the characteristics of the siloxane compound on the surfaces of the silica particles is exhibited. Although the mechanism of this is not clear, when the silica particles flow, the mold releasability due to the siloxane compound is easily exhibited by adhesion of the siloxane compound with relatively high viscosity in a small amount within the range. Alternatively, the force between particles is decreased due to the steric hindrance of the siloxane compound, and thus adhesion between the silica particles is decreased. Therefore, flowability of the silica particles and the dispersibility in the toner particles are further increased.

Meanwhile, when the silica particles are pressed, long chains of the siloxane compound on the surfaces of the silica particles are entangled, and the closest packing property of the silica particles is increased, thereby increasing aggregation of the silica particles. In addition, the cohesive force of the silica particles due to entanglement of the long chains of the siloxane compound is considered to be released by flowing the silica particles. In addition, the adhesion to the toner particles is also increased by the long chains of the siloxane compound on the surfaces of the silica particles.

According the above, the specific silica particles with surfaces to which the siloxane compound having viscosity within the range described above adheres in a small amount within the range described above easily satisfy the requirements of the compression-aggregation degree and the particle compression ratio and easily satisfy the requirement of the degree of particle dispersion.

The configuration of the toner is described in detail below.

(Toner Particles)

The toner particles contain, for example, a binder resin. If required, the toner particles may contain a coloring agent, a mold release agent, other additives, etc.

—Binder Resin—

Examples of the binder resin include vinyl resins containing homopolymers of monomers or copolymers of combination of two or more of the monomers, such as styrenes (for example, styrene, para-chlorostyrene, α-methyl styrene, and the like), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and the like), ethylenically unsaturated nitriles (for example, acrylonitrile, methacrylonitrile, and the like), vinyl ethers (for example, vinyl methyl ether, vinyl isobutyl ether, and the like), vinyl ketones (for example, vinyl methyl ketone, vinyl ethyl ketone, vinyl isopropenyl ketone, and the like), olefins (for example, ethylene, propylene, butadiene, and the like).

Other examples of the binder resin include non-vinyl resins such as epoxy resins, polyester resins, polyurethane resins, polyamide resins, cellulose resins, polyether resins, modified rosin, and the like, a mixture of the non-vinyl resin and the vinyl resin, graft polymers produced by polymerizing the vinyl monomers in coexistence with any one of the non-vinyl resins.

These binder resins may be used alone or in combination of two or more.

The binder resin is preferably a polyester resin.

Examples of the polyester resin include known polyester resins.

The polyester resin is, for example, a condensation polymer of a polyhydric carboxylic acid and a polyhydric alcohol. The polyester resin used may be a commercial product or a synthesized product.

Examples of the polyhydric carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, sebacic acid, and the like), alicyclic dicarboxylic acids (for example, cyclohexane dicarboxylic acid and the like), aromatic dicarboxylic acids (for example, terephthalic acid, isophthalic acid, phthalic acid, naphthalene dicarboxylic acid, the like), acid anhydrides thereof, and lower (for example, 1 to 5 carbon atoms) alkyl esters thereof. Among these, for example, aromatic dicarboxylic acids are preferred as the polyhydric carboxylic acid.

The polyhydric carboxylic acid may be a combination of dicarboxylic acid and a tri- or higher-hydric carboxylic acid having a crosslinked structure or branched structure. Examples of the tri- or higher-hydric carboxylic acid include trimellitic acid, pyromellitic acid, anhydrides thereof, lower (for example, 1 to 5 carbon atoms) alkyl esters thereof, and the like.

The polyhydric carboxylic acids may be used alone or in combination of two or more.

Examples of polyhydric alcohol include aliphatic diols (for example, ethylene glycol, diethylene glycol, triethylene glycol, propylene glycol, butanediol, hexanediol, neopentyl glycol, and the like), alicyclic diols (for example, cyclohexanediol, cyclohexane dimethanol, hydrogenated bisphenol A, and the like), aromatic diols (for example, bisphenol A ethylene oxide adduct, bisphenol A propylene oxide adduct, and the like). Among these, for example, aromatic diols and alicyclic diols are preferred as the polyhydric alcohol, and the aromatic diols are more preferred.

The polyhydric alcohol may be a combination of diol and a tri- or higher-hydric alcohol having a crosslinked structure or branched structure. Examples of the tri- or higher-hydric alcohol include glycerin, trimethylolpropane, and pentaerythritol.

The polyhydric alcohols may be used alone or in combination of two or more.

The polyester resin preferably has a glass transition temperature (Tg) of 50° C. or more and 80° C. or less, and more preferably 50° C. or more and 65° C. or less.

The glass transition temperature is determined from a DSC curve obtained by differential scanning calorimetry (DSC). More specifically, the glass transition temperature is determined by "Extrapolation Glass Transition Onset Temperature" described in "Determination of Glass Transition Temperature" in JIS K 7121-1987 "Testing Methods for Transition Temperatures of Plastics".

The weight-average molecular weight (Mw) of the polyester resin is preferably 5,000 or more and 1,000,000 or less and more preferably 7,000 or more and 500,000 or less.

The number-average molecular weight (Mn) of the polyester resin is preferably 2,000 or more and 100,000 or less.

The molecular weight distribution Mw/Mn of the polyester resin is preferably 1.5 or more and 100 or less and more preferably 2 or more and 60 or less.

The weight-average molecular weight and number-average molecular weight are measured by gel permeation chromatography (GPC). The molecular weight is measured by GPC using GPC HLC-8120GPC manufactured by Tosoh Corporation as a measurement apparatus and a column TSK gel Super HM-M (15 cm) manufactured by Tosoh Corporation, and a THF solvent. The weight-average molecular weight and number-average molecular weight are calculated from the measurement results by using a molecular weight calibration curve formed by using monodisperse polystyrene standard samples.

The polyester resin can be produced by a known production method. Specifically, the polyester resin can be produced by, for example, a method in which reaction is performed at a polymerization temperature of 180° C. or more and 230° C. or less and, if required, in a reaction system under reduced pressure, the reaction is performed while the water and alcohol produced during condensation are removed.

When a monomer used as a raw material is insoluble or incompatible at the reaction temperature, a solvent having a high boiling point may be added as a solubilizing agent for dissolution. In this case, polycondensation reaction is performed while the solubilizing agent is distilled off. When a monomer having low compatibility is present, the monomer having low compatibility may be previously condensed with an acid or alcohol which is expected to be polycondensed with the monomer having low compatibility, and then polycondensed with a principal component.

The content of the binder resin is, for example, preferably 40% by mass or more 95% by mass or less, more preferably 50% by mass or more and 90% by mass or less, and still more preferably 60% by mass or more and 85% by mass or less relative to the total of toner particles.

—Coring Agent—

Examples of the coloring agent include various pigments such as carbon black, chrome yellow, hansa yellow, benzidine yellow, threne yellow, quinoline yellow, pigment yellow, permanent orange GTR, pyrazolone orange, Vulcan orange, watch young red, permanent red, brilliant carmine 3B, brilliant carmine 6B, DuPont oil red, pyrazolone red, lithol red, rhodamine B late, lake red C, pigment red, rose Bengal, aniline blue, ultramarine blue, calco oil blue, methylene blue chloride, phthalocyanine blue, pigment blue, phthalocyanine green, malachite green oxalate, and the like; various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, thiazole dyes, and the like.

The coloring agents may be used alone or in combination of two or more.

If required, the coloring agent may be surface-treated or used in combination with a dispersant. Also, plural types of coloring agents may be used.

The content of the coloring agent is, for example, preferably 1% by mass or more 30% by mass or less and more preferably 3% by mass or more and 15% by mass or less relative to the total of toner particles.

—Mold Release Agent—

Examples of the mold release agent include hydrocarbon wax, natural wax such as carnauba wax, rice bran wax, candelilla wax, and the like, synthetic or mineral/petroleum wax such as montan wax and the like, ester-based wax such as fatty acid esters, montanic acid esters, and the like, and the like. The mold release agent is not limited to these.

The melting temperature of the mold release agent is preferably 50° C. or more and 110° C. or less and more preferably 60° C. or more and 100° C. or less.

The melting temperature is determined from a DSC curve obtained by differential scanning calorimetry (DSC) according to "Melting Peak Temperature" described in "Determination of Melting Temperature" in JIS K 7121-1987 "Testing Methods for Transition Temperatures of Plastics".

The content of the mold release agent is, for example, preferably 1% by mass or more 20% by mass or less and more preferably 5% by mass or more and 15% by mass or less relative to the total of toner particles.

—Other Additives—

Examples of other additives include known additives such as a magnetic material, a charging control agent, an inorganic power, and the like. These additives are contained as internal additives in the toner particles.

—Characteristics Etc. of Toner Particles—

The toner particles may be toner particles with a single-layer structure or a so-called core-shell structure including a core part (core particle) and a coating layer (shell layer) coating the core part.

The toner particles with a core-shell structure may include, for example, a core part containing the binder resin and, if required, other additives such as the coloring agent, the mold release agent, and the like, and a coating layer containing the binder resin.

The volume-average particle diameter (D50v) of the toner particles is preferably 2 μm or more and 10 μm or less and more preferably 4 μm or more and 8 μm or less.

Various average particle diameters and various particle size distribution indexes of the toner particles are measured by using Coulter Multisizer II (manufacture by Beckman Coulter Inc.) and ISOTON-II (manufactured by Beckman Coulter Inc.) as an electrolyte.

In measurement, 0.5 mg or more and 50 mg or less of a measurement sample is added to 2 ml of a 5% aqueous solution of a surfactant (sodium alkylbenzenesulfonate) used as a dispersant. The resultant mixture is added to 100 ml or more and 150 ml or less of the electrolyte.

The electrolyte in which the sample is suspended is dispersed by an ultrasonic disperser for 1 minute and a particle size distribution of particles having particle diameters within a range of 2 μm or more and 60 μm or less is measured by Coulter Multisizer II using an aperture having an aperture diameter of 100 μm. The number of particles sampled is 50,000.

The measured particle size distribution is divided into particle size ranges (channels), and volume- and number-based cumulative distributions from the small-diameter side are formed. The cumulative 16% particle diameter is defined as volume particle diameter D16v and number particle diameter D16p, the cumulative 50% particle diameter is defined as volume-average particle diameter D50v and number-average particle diameter D50p, and the cumulative 84% particle diameter is defined as volume particle diameter D84v and number particle diameter D84p.

By using these values, the volume-average particle size distribution index (GSDv) is calculated as $(D84v/D16v)^{1/2}$, and the number-average particle size distribution index (GSDp) is calculated as $(D84p/D16p)^{1/2}$.

The average circularity of the toner particles is preferably 0.95 or more and 1.00 or less and more preferably 0.98 or more and 1.0 or less. That is, the shape of the toner particles is preferably close to a spherical shape. The average circularity of the toner particles is measured by FPIA-3000 manufactured by Sysmex Corporation. The apparatus uses a system in which particles dispersed in water or the like are measured by a flow-type image analysis method, and a sucked particle dispersion is introduced into a flat sheath flow cell and forms a flat sample flow by a sheath liquid. The sample flow is irradiated with strobe light and the particles which are passing are imaged as a still image by a charge coupled device (CCD) camera through an objective lens. The imaged particle image is subjected to two-dimensional image processing and the equivalent circle diameter and circularity are calculated from a projected area and circumferential length. With respect to the equivalent circle diameter, the diameter of a circle having the same area as each of the particles photographed is calculated as the equivalent circle diameter from the area in the two-dimensional image. With respect to the circularity, the average circularity is determined by image analysis and statistical process of at least 4,000 particles.

$$\text{Circularity}=\text{equivalent circle diameter circumference/circumference}=[2\times(A\pi)^{1/2}]/PM$$

In the formula, A represents a projected area, and PM represents the circumference.

In the measurement, a PHF mode (high resolution mode) is used, and the dilution factor is 1.0.

In data analysis, for the purpose of eliminating measurement noise, the range of number particle diameter analysis is 2.0 μm or more and 30.1 μm or less, and the range of circularity analysis is 0.40 or more and 1.00 or less.

(External Additive)

The external additive includes the specific silica particles and the PTFE particles. The external additive may another additive other than the specific silica particles and the PTFE particles. That is, the specific silica particles and the PTFE particles may be externally added to the toner particles, or the specific silica particles, the PTFE particles, and another external additive may be externally added to the toner particles.

[Specific Silica Particles]

—Compression-Aggregation Degree—

The compression-aggregation degree of the specific silica particles is 60% or more and 95% or less. However, the compression-aggregation degree is preferably 65% or more and 95% or less and more preferably 70% or more and 95% or less from the viewpoint of securing flowability and dispersibility in the toner particles (particularly, from the viewpoint of suppressing image deletion) while maintaining the good aggregation property of the specific silica particles and good adhesion to the toner particles.

The compression-aggregation degree is calculated by a method described below.

A disk-shaped mold having a diameter of 6 cm is filled with 6.0 g of the specific silica particles. Next, the mold is compressed under a pressure of 5.0 t/cm$^2$ for 60 seconds by using a compression molding machine (manufactured by Maekawa Testing Machine Mfg Co., Ltd.) to produce a compressed disk-shaped compact (hereinafter a "compact before dropping") of the specific silica particles. Then, the mass of the compact before dropping is measured.

Next, the compact before dropping is placed on a sieving screen having an opening of 600 μm and dropped by using a vibration sieving machine (manufactured by Tsutsui Scientific Instruments Co., Ltd., part No. VIBRATING MVB-1) under the conditions including an amplitude of 1 mm and a vibration time of 1 minute. Consequently, the specific silica particles are dropped from the compact before dropping through the sieving screen, leaving the compact of the specific silica particles on the sieving screen. Then, the mass of the remaining compact of the specific silica particles (hereinafter referred to as a "compact after dropping") is measured.

The compression-aggregation degree is calculated from a ratio of the mass of the compact after dropping to the mass of the compact before dropping according a formula (1) below.

Compression-aggregation degree=(mass of compact after dropping/mass of compact before dropping)×100 Formula (1):

—Particle Compression Ratio—

The particle compression ratio of the specific silica particles is 0.20 or more and 0.40 or less. However, the particle compression ratio is preferably 0.24 or more and 0.38 or less and more preferably 0.28 or more and 0.36 or less from the viewpoint of securing flowability and dispersibility in the toner particles (particularly, from the viewpoint of suppressing image deletion) while maintaining the good aggregation property of the specific silica particles and good adhesion to the toner particles.

The particle compression ratio is calculated by a method described below.

The loose apparent specific gravity and packed apparent specific gravity of the silica particles are measured by using a powder tester (manufactured by Hosokawa Micron Ltd., part No. PT-S model). The particle compression ratio is calculated from a ratio of a difference between the packed apparent specific gravity and the loose apparent specific gravity of the silica particles to the packed apparent specific gravity according to formula (2) below.

Particle compression ratio=(packed apparent specific gravity−loose apparent specific gravity)/(packed apparent specific gravity) Formula (2):

The loose apparent specific gravity is a measured value derived by filling a container having a volume of 100 $cm^3$ with silica particles and weighing the container and represents a packing specific gravity in a state in which the specific silica particles are naturally dropped in the container. The packed apparent specific gravity represents an apparent specific gravity in a deaerated state in which the specific silica particles in the loose apparent specific gravity state are re-arranged and more closely packed by repeatedly applying impact (tapping) 180 times to the bottom of the container with a stroke length of 18 mm and a tapping rate of 50 times/min.

—Particle Dispersion Degree—

The particle dispersion degree of the specific silica particles is preferably 90% or more and 100% or less, more preferably 95% or more and 100% or less, and still more preferably 100% from the viewpoint of further improving dispersibility in the toner particles (particularly, from the viewpoint of suppressing image deletion).

The particle dispersion degree is shown by a ratio of measured coverage C of the toner particles to calculated coverage $C_0$ and is calculated by using formula (3) below.

Particle dispersion degree=measured coverage $C$/calculated coverage $C_0$ Formula (3):

The calculated coverage $C_0$ of the surfaces of the toner particles with the specific silica particles can be calculated by formula (3-1) below using the volume-average particle diameter dt (m) of the toner particles, the average equivalent circle diameter da (m) of the specific silica particles, the specific gravity ρt of the toner particles, the specific gravity pa of the specific silica particles, the weight Wt (kg) of the toner particles, and the weight Wa (kg) of the specific silica particles added.

Calculated coverage $C_0=\sqrt{3}/(2\pi)\times(\rho t/\rho a)\times(dt/da)\times(Wa/Wt)\times100(\%)$ Formula (3-1):

The measured coverage C of the surfaces of the toner particles with the specific silica particles can be calculated by formula (3-2) below using the signal intensities of silicon atoms derived from the specific silica particles measured for the toner particles alone, the specific silica particles alone, the toner particles coated with the specific silica particles (adhering) by an X-ray photoelectron spectrometer (XPS) ("JPS-9000MX": manufactured by JEOL Ltd.).

Measured coverage $C=(z-x)/(y-x)\times100(\%)$ Formula (3-2):

In the formula (3-2), x represents the signal intensity of silicon atoms derived from the specific silica particles of the toner particles alone, y represents the signal intensity of silicon atoms derived from the specific silica particles of the specific silica particles alone, and z represents the signal intensity of silicon atoms derived from the specific silica particles of the toner particles coated with the specific silica particles (adhering).

—Average Equivalent Circle Diameter—

The average equivalent circle diameter of the specific silica particles is preferably 40 nm or more and 200 nm or less, more preferably 50 nm or more and 180 nm or less, and still more preferably 60 nm or more and 160 nm or less from the viewpoint of improving the flowability, dispersibility in the toner particles, aggregation property, and adhesion to the toner particles with respect to the specific silica particles (particularly, from the viewpoint of suppressing image deletion).

With respect to the average equivalent circle diameter D50 of the specific silica particles, the primary particles after the specific silica particles are externally added to the toner particles are observed with a scanning electron microscope (SEM) apparatus (manufactured by Hitachi, Ltd.: S-4100) and an image is photographed. The image is introduced into an image analysis apparatus (LUZEX III, manufactured by Nireco Inc.), the areas of the primary particles are measured by image analysis, and equivalent circle diameters are calculated from the area values. The diameter (D50) at a cumulative frequency of 50% in volume-based distribution of the equivalent circle diameters is regarded as the average equivalent circle diameter D50 of the specific silica particles. The magnification of the electron microscope is adjusted so that about 10 or more and 50 or less of specific silica particles are observed in a viewing field, plural viewing fields are observed for determining the equivalent circle diameter of the primary particles.

—Average Circularity—

The shape of the specific silica particles may be any one of a spherical shape and an irregular shape, but the average circularity of the specific silica particles is preferably 0.85 or more and 0.98 or less, more preferably 0.90 or more and 0.98 or less, and still more preferably 0.93 or more and 0.98 or less from the viewpoint of improving the flowability, dispersibility in the toner particles, aggregation property, and adhesion to the toner particles with respect to the specific silica particles (particularly, from the viewpoint of suppressing image deletion).

The average circularity of the specific silica particles is measured by a method described below.

First, the circularity of the specific silica particles is determined by observing, with a SEM apparatus, primary particles after the silica particles are external added to the toner particles, and "100/SF2" is calculated by a formula below based on plane image analysis of the primary particles.

$$\text{Circularity}(100/SF2)=4\pi\times(A/I^2) \qquad \text{Formula:}$$

In the formula, I represents the circumference of the primary particle in an image, and A represents a projected area of the primary particle.

The average circularity of the specific silica particles is determined as circularity at a cumulative frequency of 50% in circularity distribution of 100 primary particles based on the plane image analysis.

Methods for measuring the characteristics (compression-aggregation degree, particle compression ratio, particle dispersion degree, and average circularity) of the specific silica particles of a toner are described below.

First, the specific silica particles are separated from a toner as follows.

The toner is placed and dispersed in methanol and stirred, and then the external additive can be separated from the toner by treatment in an ultrasonic bath. Since the ease of separation is determined by the particle diameter and specific gravity of the external additive and the PTFE particles having a large diameter can be easily separated, only the PTFE particles can be separated from the toner surfaces by setting weak ultrasonic treatment conditions. Then, the specific silica particles can be separated from the toner particles by changing the ultrasonic treatment conditions. At each of the times of separation, the toner is sedimented by centrifugal separation, and only methanol in which each of the external additives is dispersed is recovered. Then, the specific silica particles and the PTFE particles can be obtained by evaporating methanol. It is necessary to adjust the ultrasonic treatment conditions according to the specific silica particles and the PTFE particles.

The characteristics described above are measured by using the separated specific silica particles.

The configuration of the specific silica particles is described in detail below.

—Specific Silica Particles—

The specific silica particles are particles containing silica (that is, $SiO_2$) as a principal component and may be either crystalline or amorphous. The specific silica particles may be particles produced by using a silicon compound such as water glass, alkoxysilane, or the like as a raw material or particles produced by grinding quartz.

Examples of the specific silica particles include silica particles (hereinafter referred to as "sol-gel silica particles") produced by a sol-gel method, aqueous colloidal silica particles, alcoholic silica particles, fumed silica particles produced by a vapor-phase method, fused silica particles, and the like. Among these, sol-gel silica particles are preferred.

—Surface Treatment—

The specific silica particles are preferably surface-treated with a siloxane compound in order to control the compression-aggregation degree, particle compression ratio, and particle dispersion degree within the specific ranges described above.

The surface treatment method is preferably surface treatment of the surfaces of the silica particles with supercritical carbon dioxide in supercritical carbon dioxide. The surface treatment method is described later.

—Siloxane Compound—

The siloxane compound is not particularly limited as long as it has a siloxane skeleton in its molecular structure.

Examples of the siloxane compound include silicone oil and a silicone resin. Among these, silicone oil is preferred from the viewpoint of nearly uniform surface treatment of the surfaces of the silicone particles.

Examples of the silicone oil include dimethyl silicone oil, methyl hydrogen silicone oil, methyl phenyl silicone oil, amino-modified silicone oil, epoxy-modified silicone oil, carboxyl-modified silicone oil, carbinol-modified silicone oil, methacryl-modified silicone oil, mercapto-modified silicone oil, phenol-modified silicone oil, polyether-modified silicone oil, methylstyryl-modified silicone oil, alkyl-modified silicone oil, higher-fatty acid ester-modified silicone oil, higher fatty acid amide-modified silicone oil, fluorine-modified silicone oil, and the like. Among these, dimethyl silicone oil, methyl hydrogen silicone oil, and amino-modified silicone oil are preferred.

The siloxane compounds may be used alone or in combination of two or more.

—Viscosity—

The viscosity (kinematic viscosity) of the siloxane compound is preferably 1000 cSt or more and 50000 cSt or less, more preferably 2000 cSt or more and 30000 cSt or less, and still more preferably 3000 cSt or more and 10000 cSt or less from the viewpoint of improving the flowability, dispersibility in the toner particles, aggregation property, and adhesion to the toner particles with respect to the specific silica particles (particularly, from the viewpoint of suppressing image deletion).

The viscosity of the siloxane compound is determined according to the following procedures. Toluene is added to the specific silica particles which are then dispersed by an ultrasonic disperser. Then, a supernatant is recovered. In this case, a toluene solution of the siloxane compound is a concentration of 1 g/100 ml. The specific viscosity $[\eta_{sp}]$ (25° C.) is determined by a formula (A) below.

$$\eta_{sp}=(\eta/\eta_0)-1 \qquad \text{Formula (A):}$$

($\eta_0$: viscosity of toluene, $\eta$: viscosity of solution)

The intrinsic viscosity $[\eta]$ is determined by substituting the specific viscosity $[\eta_{sp}]$ in a Huggins relational formula shown by formula (B) below.

$$\eta_{sp}=[\eta]+K'[\eta]^2 \qquad \text{Formula (B):}$$

(K': Huggins constant K'=0.3 (application of $[\eta]$=1 to 3))

Next, the molecular weight M is determined by substituting the intrinsic viscosity $[\eta]$ into an equation of A. Kolorlov shown by formula (C) below.

$$[\eta]=0.215\times10^{-4}M^{0.65} \qquad \text{Formula (C):}$$

The siloxane viscosity $[\eta]$ is determined by substituting the molecular weight M into an equation of A. J. Barry shown by formula (D) below.

$$\log\eta=1.00+0.0123M^{0.5} \qquad \text{Formula (D):}$$

—Amount of Surface Adhesion—

The amount of surface adhesion of the siloxane compound to the surfaces of the specific silica particles is preferably 0.01% by mass or more and 5% by mass or less, more preferably 0.05% by mass or more and 3% by mass or less, and still more preferably 0.10% by mass or more and 2% by mass or less relative to the silica particles (silica particles before surface treatment) from the viewpoint of improving the flowability, dispersibility in the toner particles, aggregation property, and adhesion to the toner particles with respect to the specific silica particles (particularly, from the viewpoint of suppressing image deletion).

The amount of surface adhesion is measured by a method described below.

First, 100 mg of the specific silica particles is dispersed in 1 mL of chloroform, and 1 μL of DMF (N,N-dimethylformamide) is added as an internal standard solution to the resultant dispersion. Then, the siloxane compound is extracted in the chloroform solvent by ultrasonic treatment using an ultrasonic cleaning device for 30 minutes. Then, a spectrum of hydrogen nuclei is measured by JNM-AL400 model nuclear magnetic resonance spectrometer (manufactured by JEOL DATUM Ltd.), the amount of the siloxane compound is determined from a ratio of a peak area due to the siloxane compound to a peak area due to DMF. The amount of surface adhesion is determined from the amount of the siloxane compound.

The specific silica particles are surface-treated with the siloxane compound having a viscosity of 1,000 cSt or more and 50,000 cSt or less, and the amount of surface adhesion of the siloxane compound to the surfaces of the silica particles is preferably 0.01% by mass or more and 5% by mass or less.

By satisfying the requirements, the specific silica particles having good flowability and good dispersibility in the toner particles and the improved aggregation property and adhesion to the toner particles may be easily produced.

[Method for Producing Specific Silica Particles]

The specific silica particles are produced by surface-treating the surfaces of silica particles with the siloxane compound with a viscosity of 1,000 cSt or more 50,000 cSt or less so that the amount of surface adhesion is 0.01% by mass or more and 5% by mass or less relative to the silica particles.

According to the method for producing the specific silica particles, silica particles having good flowability and good dispersibility in the toner particles and the improved aggregation property and adhesion to the toner particles may be produced.

Examples of the surface treatment method include a method of surface-treating the surfaces of the silica particles with the siloxane compound in supercritical carbon dioxide, and a method of surface-treating the surfaces of the silica particles with the siloxane compound in the air.

Specific examples of the surface treatment method include a method of adhering the siloxane compound to the surfaces of the silica particles by dissolving the siloxane compound in supercritical carbon dioxide; a method of adhering the siloxane compound to the surfaces of the silica particles by applying (for example, spraying or coating), in the air, a solution containing the siloxane compound and a solvent which dissolves the siloxane compound to the surfaces of the silica particles; and a method of adding, in the air, a solution containing the siloxane compound and a solvent which dissolves the siloxane compound to a silica particle dispersion, maintaining the resultant mixture, and then drying the mixture of the silica particle dispersion and the solution.

In particular, the method of adhering the siloxane compound to the surfaces of the silica particles by using supercritical carbon dioxide is preferred as the surface treatment method.

The surface treatment in supercritical carbon dioxide creates a state in which the siloxane compound is dissolved in the supercritical carbon dioxide. The supercritical carbon dioxide has the property of low surface tension, and thus the siloxane compound dissolved in the supercritical carbon dioxide is considered to easily diffuse, together with the supercritical carbon dioxide, and reach deep parts of pores in the surfaces of the silica particles. Therefore, it is considered that not only the surfaces of the silica particles but also deep parts of the pores are surface-treated with the siloxane compound.

Thus, the silica particles surface-treated with the siloxane compound in supercritical carbon dioxide are considered to be silica particles surface-treated nearly uniformly with the siloxane compound (for example, in a state in which a surface treatment layer is formed in a thin film).

In the method for producing the specific silica particles, surface treatment may be also performed for imparting hydrophobicity to the surfaces of the silica particles by using a hydrophobizing agent in combination with the siloxane compound in supercritical carbon dioxide.

This surface treatment creates a state in which the hydrophobizing agent, together with the siloxane compound, is dissolved in supercritical carbon dioxide. The siloxane compound and hydrophobizing agent dissolved in the supercritical carbon dioxide are considered to easily diffuse, together with the supercritical carbon dioxide, and reach deep parts of pores in the surfaces of the silica particles. Therefore, it is considered that not only the surfaces of the silica particles but also deep parts of the pores are surface-treated with the siloxane compound and the hydrophobizing agent.

As a result, the silica particles surface-treated with the siloxane compound and the hydrophobizing agent in the supercritical carbon dioxide are easily surface-treated nearly uniformly with the siloxane compound and the hydrophobizing agent and imparted with high hydrophobicity.

The method for producing the specific silica particles may use supercritical carbon dioxide in another process for producing silica particles (for example, a solvent removing process or the like).

The method for producing the specific silica particles using supercritical carbon dioxide in the other production process is, for example, a method including preparing a silica particle dispersion containing silica particles and a solvent containing alcohol and water by a sol-gel method (hereinafter, referred to as "dispersion preparation"), removing the solvent from the silica particle dispersion by circulating the supercritical carbon dioxide (hereinafter, referred to as "solvent removal"), and surface-treating the surfaces of the silica particles, from which the solvent has been removed, with the siloxane compound in the supercritical carbon dioxide.

When the solvent is removed from the silica particle dispersion by using the supercritical carbon dioxide, the occurrence of coarse powder can be easily suppressed.

Although the reason for this is unclear, conceivable reasons are as follows: 1) When the solvent is removed from the silica particle dispersion, the solvent can be removed without aggregation of particles due to the liquid bridge force during removal of the solvent because of the property of supercritical carbon dioxide that surface tension does not act. 2) Because of the property of supercritical carbon dioxide that supercritical carbon dioxide is carbon dioxide under conditions of temperature and pressure higher than the critical point and thus has both the diffusion property of gas and the dissolving property of liquid, the supercritical carbon dioxide efficiently comes in contact with the solvent and dissolves the solvent at a relatively low temperature (for example, 250° C. or less), and the supercritical carbon dioxide in which the solvent is dissolved is removed so that the solvent in the silica particle dispersion can be removed without producing coarse powder such as secondary aggregate or the like caused by silanol group condensation.

The solvent removal and the surface treatment may be separately performed but are preferably continuously performed (that is, each of the processes is performed in a state not opened under the atmospheric pressure). When the processes are continuously performed, the silica particles have no opportunity to adsorb water after the solvent removal, and the surface treatment can be performed in a state in which excessive adsorption of water on the silica particles is suppressed. Therefore, a large amount of the siloxane compound need not be used, and the solvent removal and the surface treatment need not be performed at high temperature by excessive heating. Consequently, the occurrence of a coarse powder can be more effectively easily suppressed.

Each of the processes of the method for producing the specific silica particles is described in detail below.

The method for producing the specific silica particles is not limited to the above, and for example, the method may be performed under conditions 1) in which only the surface treatment uses supercritical carbon dioxide or 2) in which the processes are separately performed.

Each of the processes is described in detail below.

—Preparation of Dispersion—

In the preparation of the dispersion, the silica particle dispersion containing, for example, the silica particles and a solvent containing alcohol and water is prepared.

Specifically, in the preparation of the dispersion, the silica particle dispersion is prepared by, for example, a wet method (for example, a sol-gel method or the like). In particular, the sol-gel method is preferred as the wet method, and specifically, the silica particles are produced by reaction (hydrolysis reaction and condensation reaction) of tetraalkoxy silane in the presence of an alkali catalyst in a solvent containing alcohol and water, preparing the silica particle dispersion.

The preferred range of the average equivalent circle particle diameter and the preferred range of the average circularity of the silica particles are as described above.

For example, when the silica particles are produced by the wet method, a dispersion (silica particle dispersion) in which the silica particles are dispersed in the solvent is produced in the preparation of the dispersion.

In transferring to the solvent removal, the silica particle dispersion prepared has a water-to-alcohol mass ratio of, for example, 0.05 or more and 1.0 or less, preferably 0.07 or more and 0.5 or less, and more preferably 0.1 or more and 0.3 or less.

When the silica particle dispersion has a water-to-alcohol mass ratio within the range described above, a coarse powder of the silica particles little occurs after the surface treatment, and the silica particles having good electrical resistance may be easily produced.

When the water-to-alcohol mass ratio is lower than 0.05, silanol group condensation little occurs on the surfaces of the silica particles during solvent removal in the solvent removal process, the amount of water adsorbed on the surfaces of the silica particles after the solvent removal is increased, and thus the electrical resistance of the silica particles after the surface treatment may be excessively decreased. While when the water-to-alcohol mass ratio exceeds 1.0, a large amount of water remains near the end point of the solvent removal from the silica particle dispersion in the solvent removal process, and thus aggregation of the silica particles may easily occur due to liquid bridge force and may be present as a coarse powder after the surface treatment.

Also, in transferring to the solvent removal, the silica particle dispersion prepared has a water-to-silica particle mass ratio of, for example, 0.02 or more and 3 or less, preferably 0.05 or more and 1 or less, and more preferably 0.1 or more and 0.5 or less.

When the silica particle dispersion has a water-to-silica particle mass ratio within the range described above, a coarse powder of the silica particles little occurs, and the silica particles having good electrical resistance may be easily produced.

When the water-to-silica particle mass ratio is lower than 0.02, silanol group condensation on the surfaces of the silica particles is extremely decreased during solvent removal in the solvent removal process, the amount of water adsorbed on the surfaces of the silica particles after the solvent removal is increased, and thus the electrical resistance of the silica particles may be excessively decreased.

While when the water-to-silica particle mass ratio exceeds 3, a large amount of water remains near the end point of the solvent removal from the silica particle dispersion in the solvent removal process, and thus aggregation of the silica particles may easily occur due to liquid bridge force.

Also, in transferring to the solvent removal, the silica particle dispersion prepared has a silica particle-to-silica particle dispersion mass ratio of, for example, 0.05 or more and 0.7 or less, preferably 0.2 or more and 0.65 or less, and more preferably 0.3 or more and 0.6 or less.

When the silica particle-to-silica particle dispersion mass ratio is lower than 0.05, the amount of supercritical carbon dioxide used in the solvent removal may be increased, and productivity may be degraded.

While when the silica particle-to-silica particle dispersion mass ratio exceeds 0.7, the distance between the silica particles in the silica particle dispersion is decreased, and thus the occurrence of a coarse powder may easily occur due to aggregation or gelation of the silica particles.

—Solvent Removal—

In the solvent removal, the solvent in the silica particle dispersion is removed by, for example, circulating supercritical carbon dioxide.

That is, in the solvent removal, supercritical carbon dioxide is brought into contact with the silica particle dispersion by circulating the supercritical carbon dioxide, thereby removing the solvent.

Specifically, in the solvent removal, for example, the silica particle dispersion is placed in a closed reactor. Then, liquefied carbon dioxide is added and heated in the closed reactor and then put into a supercritical state by increasing the pressure in the reaction using a high-pressure pump. Then, the supercritical carbon dioxide is circulated in the closed reactor, that is, in the silica particle dispersion, by introducing and discharging the supercritical carbon dioxide into and from the closed reactor.

Thus, the supercritical carbon dioxide in which the solvent (alcohol and water) is dissolved and which is accompanied with the solvent is discharged to the outside of the silica particle dispersion (the outside of the closed reactor), and consequently the solvent is removed.

The supercritical carbon dioxide is carbon dioxide under conditions of temperature and pressure higher than the critical point and has both the diffusion property of gas and the dissolving property of liquid.

The temperature condition of solvent removal, that is, the temperature of the supercritical carbon dioxide, is, for example, 31° C. or more and 350° C. or less, preferably 60° C. or more and 300° C. or less, and more preferably 80° C. or more and 250° C. or less.

At the temperature less than the range described above, the solvent is slightly dissolved in the supercritical carbon dioxide, thereby making it difficult to remove the solvent. Also, it is considered that a coarse powder easily occurs due to the liquid bridge force of the solvent and supercritical carbon dioxide. Meanwhile, at the temperature exceeding the range described above, it is considered that a coarse powder such as a secondary aggregate or the like easily occurs due to silanol group condensation on the surfaces of the silica particles.

The pressure of solvent removal, that is, the pressure of the supercritical carbon dioxide, is, for example, 7.38 MPa or more and 40 MPa or less, preferably 10 MPa or more and 35 MPa or less, and more preferably 15 MPa or more and 25 MPa or less.

At the pressure less than the range described above, the solvent tends to be slightly dissolved in the supercritical carbon dioxide, while at the pressure exceeding the range described above, the equipment cost tends to be increased.

Also, the amount of supercritical carbon dioxide introduced into and discharged from the closed reactor is, for example, 15.4 L/min/$m^3$ or more and 1540 L/min/$m^3$ or less and preferably 77 L/min/$m^3$ or more and 770 L/min/$m^3$ or less.

When the amount of supercritical carbon dioxide introduced and discharged is less than 15.4 L/min/$m^3$, much time is required for removing the solvent, and thus productivity tends to be easily degraded.

Meanwhile, when the amount of supercritical carbon dioxide introduced and discharged exceeds 1540 L/min/$m^3$, the supercritical carbon dioxide is short-passed, and thus the time of contact with the silica particle dispersion is shortened, thereby causing the tendency to make it difficult to efficiently remove the solvent.

—Surface Treatment—

In the surface treatment, the surfaces of the silica particles are treated with the siloxane compound in supercritical carbon dioxide in succession with the solvent removal.

That is, in the surface treatment, for example, the surfaces of the silica particles are treated with the siloxane compound in supercritical carbon dioxide without exposure to the atmosphere before transfer from the solvent removal.

Specifically, in the surface treatment, for example, after the introduction and discharge of supercritical carbon dioxide into and from the closed reactor for solvent removal is stopped, the temperature and pressure in the closed reactor are adjusted, and the siloxane compound at a predetermined ratio to the silica particles is added to the closed reactor in which the supercritical carbon dioxide is present. Then, under conditions in which this state is maintained, the silica particles are surface-treated by reaction of the siloxane compound in the supercritical carbon dioxide.

In the surface treatment, the siloxane compound may be reacted in the supercritical carbon dioxide (that is, in an atmosphere of supercritical carbon dioxide), and the surface treatment may be performed under circulation or without the circulation of supercritical carbon dioxides (that is, supercritical carbon dioxide is introduced and discharged into and from the closed reactor).

In the surface treatment, the amount (charge amount) of the silica particles relative to the volume of the reactor is, for example, 30 g/L or more and 600 g/L or less, preferably 50 g/L or more and 500 g/L or less, and more preferably 80 g/L or more and 400 g/L or less.

With the amount less than the range described above, the concentration of the siloxane compound relative to the supercritical carbon dioxide is decreased, and the probability of contact with the silica particle surfaces is decreased, thereby causing the reaction to little proceed. Meanwhile, with the amount exceeding the range described above, the concentration of the siloxane compound relative to the supercritical carbon dioxide is increased, and thus the siloxane compound is not completely dissolved in the supercritical carbon dioxide and insufficiently dispersed, thereby easily causing the occurrence of a coarse aggregate.

The density of the supercritical carbon dioxide is, for example, 0.10 g/ml or more and 0.80 g/ml or less, preferably 0.10 g/ml or more and 0.60 g/ml or less, and more preferably 0.2 g/ml or more and 0.50 g/ml or less.

With the density lower than the range described above, the solubility of the siloxane compound in the supercritical carbon dioxide is decreased, and thus an aggregate tends to occur. Meanwhile, with the density higher than the range described above, diffusion into silica fine pores is decreased, and thus the surface treatment may become insufficient. In particular, the surface treatment of sol-gel silica particles containing many silanol groups is preferably performed within the density range described above.

The density of the supercritical carbon dioxide is adjusted by temperature, pressure, and the like.

Examples of the siloxane compound are as described above. The preferred range of viscosity of the siloxane compound is also as described above.

When silicone oil is used as the siloxane compound, the silicone oil easily adheres in a nearly uniform state to the surfaces of the silica particles, and the flowability, dispersibility, and handleability of the silica particles are easily improved.

The amount of the siloxane compound used is, for example, 0.05% by mass or more and 3% by mass or less, preferably 0.1% by mass or more 2% by mass or less, and more preferably 0.15% by mass or more and 1.5% by mass or less based on the silica particles from the viewpoint that the amount of surface adhesion to the silica particles may be easily controlled to 0.01% by mass or more 5% by mass or less.

The siloxane compound may be used singly or used as a mixture with a solvent in which the siloxane compound is easily dissolved. Examples of the solvent include toluene, methyl ethyl ketone, methyl isobutyl ketone, and the like.

In the surface treatment, the silica particles may be surface-treated with a mixture of the siloxane compound and the hydrophobizing agent.

The hydrophobizing agent is, for example, a silane-based hydrophobizing agent. Examples of the silane-based hydrophobizing agent include known silicon compounds having an alkyl group (for example, a methyl group, an ethyl group, a propyl group, a butyl group, or the like). Specific examples thereof include silazane compounds (for example, silane compounds such as methyltrimethoxysilane, dimethyldimethoxysilane, trimethylchlorosilane, trimethylmethoxysilane, and the like, hexamethyldisilazane, tetramethyldisilazane, and the like) and the like. The hydrophobizing agents may be used alone or in combination of two or more.

Among the silane-based hydrophobizing agents, silicon compounds having a trimethyl group, such as trimethylmethoxysilane, hexamethyldisilazane (HMDS), and the like are preferred, and hexamethyldisilazane (HMDS) is particularly preferred.

The amount of the silane-based hydrophobizing agent used is not particularly limited and is, for example, 1% by mass or more and 100% by mass or less, preferably 3% by mass or more 80% by mass or less, and more preferably 5% by mass or more and 50% by mass or less based on the silica particles.

The silane-based hydrophobizing may be used singly or used as a mixture with a solvent in which the silane-based hydrophobizing agent is easily dissolved. Examples of the solvent include toluene, methyl ethyl ketone, methyl isobutyl ketone, and the like.

The temperature condition of the surface treatment, that is, the temperature of supercritical carbon dioxide, is, for example, 80° C. or more and 300° C. or less, preferably 100° C. or more and 250° C. or less, and more preferably 120° C. or more and 200° C. or less.

At the temperature lower than the range described above, the surface treatment ability of the siloxane compound may be decreased. Meanwhile, at the temperature exceeding the range described above, condensation reaction between silanol groups of the silica particles proceeds, and thus particle aggregation may occur. In particular, the surface treatment of sol-gel silica particles having many silanol groups is preferably performed within the temperature range described above.

Meanwhile, the pressure condition of the surface treatment, that is, the pressure of supercritical carbon dioxide, may be a condition satisfying the density described above and is, for example, 8 MPa or more and 30 MPa or less, preferably 10 MPa or more and 25 MPa or less, and more preferably 15 MPa or more and 20 MPa or less.

The specific silica particles are produced through the processes described above.

[PTFE Particles]

The PTFE particles used in the exemplary embodiment are not particularly limited. The average particle diameter of the PTFE particles is preferably 100 nm or more 500 nm or less and more preferably 200 nm or more and 400 nm or less. The PTFE particles having the particle diameter may be produced by an emulsion polymerization method or may be available as a commercial product (for example, Lubron L-2, manufactured by Daikin Industries Ltd.).

With respect to the average particle diameter of the PTFE particles, the PTFE particles are observed in 100 viewing fields (50,000 times) by using a scanning electron microscope (S-47000 model, manufactured by Hitachi, Ltd) and the diameter (average of long diameter and short diameter) of each of 1000 PTFE particles is measured by approximating the particle with a circle corresponding to the image area, and the average value is determined as the number-average primary diameter of the PTFE particles.

The composition of the PTFE particles used in the exemplary embodiment includes a tetrafluoroethylene homopolymer but may contain, for example, about 10% by mass or less of vinylidene fluoride, monofluoroethylene, or the like.

The method for measuring the average particle diameter of the PTFE particles of a toner is described below.

First, the PTFE particles are separated from the toner as follows.

The toner is placed and dispersed in methanol and stirred, and then the external additive can be separated from the toner by treatment in an ultrasonic bath. Since the ease of separation is determined by the particle diameter and specific gravity of the external additive and the PTFE particles having a large diameter can be easily separated, only the PTFE particles can be separated from the toner surfaces by setting weak ultrasonic treatment conditions. Then, the specific silica particles can be separated from the toner particles by changing the ultrasonic treatment conditions. At each of the times of separation, the toner is sedimented by centrifugal separation, and only methanol in which each of the external additives is dispersed is recovered. Next, the specific silica particles and the PTFE particles can be obtained by evaporating methanol. It is necessary to adjust the ultrasonic treatment conditions according to the specific silica particles and the PTFE particles.

The average particle diameter of the PTFE particles is measured by using the separated PTFE particles.

[Other External Additive]

Examples of other external additives include inorganic particles. Examples of the inorganic particles include $SiO_2$ (excluding the specific silica particles), $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

The surfaces of inorganic particles as the other external additive are preferably hydrophobized. Hydrophobization is performed by, for example, immersing the inorganic particles in the hydrophobizing agent. Examples of the hydrophobizing agent include, but are not particularly limited to, silane-based coupling agents, silicone oil, titanate-based coupling agents, aluminum-based coupling agents, and the like. These may be used alone or in combination of two or more The amount of the hydrophobizing agent is generally, for example, 1 part by mass or more and 10 parts by mass or less based on 100 parts by mass of the inorganic particles.

Other examples of the other external additives include resin particles (resin particles of polystyrene, polymethyl methacrylate (PMMA), melamine resin, and the like), cleaning active agents (for example, higher-fatty acid metal salts such as zinc stearate), and the like.

—Amount of External Addition—

From the viewpoint of suppressing image deletion, the amount (content) of the specific silica particles externally added is preferably 0.1% by mass or more and 6.0% by mass or less, more preferably 0.3% by mass or more and 4.0% by mass or less, and still more preferably 0.5% by mass or more and 2.5% by mass or less based on the toner particles.

From the viewpoint of suppressing image deletion, the amount of the PTFE particles added is preferably 0.05% by mass or more and 0.7% by mass or less and more preferably 0.1% by mass or more and 0.4% by mass or less based on the toner particles.

The content ratio (specific silica particles/PTFE particles) of the specific silica particles to the PTFE particles on a mass basis is preferably 2.0 or more and 30.0 or less, more preferably 4.0 or more and 20.0 or less, and still more preferably 5.0 or more and 10.0 or less.

The amount of other external additives externally added is, for example, preferably 0% by mass or more and 5.0% by mass or less and more preferably 0.5% by mass or more and 3.0% by mass or less based on the toner particles.

(Method for Producing Toner)

Next, a method for producing the toner according to the exemplary embodiment is described.

The toner according to the exemplary embodiment can be produced by producing the toner particles and then externally adding the external additives to the toner particles.

The toner particles may be produced by any one of a dry method (for example, a kneading/grinding method or the like) and a wet method (for example, an aggregation/coalescence method, a suspension polymerization method, a solution suspension method, or the like). The method for producing the toner particles is not particularly limited, and a known method is used.

Among these, the toner particles are preferably produced by the aggregation/coalescence method.

Specifically, for example, when the toner particles are produced by the aggregation/coalescence method, the toner particles are produced by preparing a resin particle dispersion in which resin particles as a binder resin are dispersed (preparation of a resin particle dispersion), forming aggregated particles by aggregating the resin particles (if required, other particles) in the resin particle dispersion (if required, in a dispersion prepared by further mixing other particle dispersions) (formation of aggregated particles), and forming toner particles by heating the resultant aggregated particle dispersion in which the aggregated particles are dispersed and fusing and coalescing the aggregated particles (fusion/coalescence).

Each of the processes is described in detail below.

Although, in the description below, the method for producing the toner particles containing the coloring agent and the mold release agent is described, the coloring agent and the mold release agent are used according to demand. Of course, other additives other than the coloring agent and the mold release agent may be used.

—Preparation of Resin Particle Dispersion—

First, a resin particle dispersion in which resin particles as a binder resin are dispersed and, for example, a coloring agent particle dispersion in which coloring agent particles are dispersed and a mold release agent particle dispersion in which mold release agent particles are dispersed are prepared.

The resin particle dispersion is prepared by, for example, dispersing the resin particles in a dispersion medium using a surfactant.

The dispersion medium used in the resin particle dispersion is, for example, an aqueous medium.

Examples of the aqueous medium include water such as distilled water, ion exchange water, and the like, alcohols, and the like. These may be used alone or in combination of two or more.

Examples of the surfactant include anionic surfactants such as sulfuric acid ester salt-based, sulfonic acid salt-based, phosphoric acid ester-based, and soap-based surfactants, and the like; cationic surfactants such as amine salt-based and quaternary ammonium salt-based surfactants, and the like; nonionic surfactants such as polyethylene glycol-based, alkylphenol ethylene oxide adduct-based, and polyhydric alcohol-based surfactants, and the like; and the like. Among these, the anionic surfactant and the cationic surfactant are preferred. The nonionic surfactant may be used in combination with the anionic surfactant or the cationic surfactant.

The surfactants may be used alone or in combination of two or more.

The method for dispersing the resin particles in the dispersion medium of the resin particle dispersion is, for example, a general dispersion method using a rotational shear-type homogenizer, a ball mill, sand mill, or dyno-mill using a medium, or the like. Also, the resin particles may be dispersed in the resin particle dispersion by, for example, using a phase-inversion emulsification method according to the type of the resin particles.

The phase-inversion emulsification method is a method including dissolving a resin to be dispersed in a hydrophobic organic solvent which can dissolve the resin, neutralizing an organic continuous phase (O phase) by adding a base, and then inverting the resin (so-called phase inversion) from W/O to O/W by adding an aqueous medium (W phase) to form a discontinuous phase, thereby dispersing particles of the resin in the aqueous medium.

The volume-average particle diameter of the resin particles dispersed in the resin particle dispersion is, for example, preferably 0.01 μm or more and 1 μm or less, more preferably 0.08 μm or more and 0.8 μm or less, and still more preferably 0.1 μm or more and 0.6 μm or less.

With respect to the volume-average particle diameter of the resin particles, a volume-based cumulative distribution is formed from the small-diameter side for divided particle size ranges (channels) by using a particle size distribution obtained by measurement with a laser diffraction particle size distribution analyzer (for example, LA-700 manufactured by Horiba, Ltd.), and the particle diameter at 50% in the cumulative distribution of the all particles is measured as volume-average particle diameter D50v. The volume-average particle diameters of particles in other dispersions are measured by the same method.

The content of the resin particles contained in the resin particle dispersion is, for example, preferably 5% by mass or more 50% by mass or less and more preferably 10% by mass or more and 40% by mass or less.

For example, the coloring agent particle dispersion, and the mold release agent particle dispersion are prepared by the same method as for the resin particle dispersion. That is, the volume-average particle diameter of the resin particles, the dispersion medium, the dispersion method, and the particle content in the resin particle dispersion are true for the coloring agent particles dispersed in the coloring agent particle dispersion and the mold release agent particles dispersed in the mold release agent particle dispersion.

—Formation of Aggregated Particles—

Next, the resin particle dispersion is mixed with the coloring agent particle dispersion and the mold release agent particle dispersion.

Then, the resin particles, the coloring agent particles, and the mold release agent particles are hetero-aggregated in the resultant mixed dispersion to form the aggregated particles which have a diameter close to the diameter of the desired toner and which contain the resin particles, the coloring agent particles, and the mold release agent particles.

Specifically, for example, a coagulant is added to the mixed dispersion, and the mixed dispersion is adjusted to acidic pH (for example, pH of 2 or more and 5 or less). If required, a dispersion stabilizer is added to the mixed dispersion. Then, the particles dispersed in the mixed dispersion are aggregated by heating to the glass transition temperature of the resin particles (for example, (resin particle glass transition temperature—30° C.) or more and (resin particle glass transition temperature—10° C.) or less, thereby forming the aggregated particles.

The aggregated particles may be formed by, for example, adding the coagulant to the mixed dispersion at room temperature (for example, 25° C.) under stirring in a rotational shear-type homogenizer, adjusting the mixed dispersion to acidic pH (for example, pH of 2 or more and 5 or less), if required adding the dispersion stabilizer to the mixed dispersion, and then heating the mixed dispersion.

Examples of the coagulant include surfactants with polarity opposite to that of the surfactant used as the dispersant added to the mixed dispersion, inorganic metal salts, and di- or higher-valent metal complexes. In particular, when a metal complex is used as the coagulant, the amount of the surfactant used is decreased, thereby improving charging characteristics.

Also, if required, an additive which forms a complex or similar bond with a metal ion of the coagulant may be used. A chelating agent is preferably used as the additive.

Examples of the inorganic metal salts include metal salts such as calcium chloride, calcium nitrate, barium chloride, magnesium chloride, zinc chloride, aluminum chloride, aluminum sulfate, and the like; inorganic metal salt polymers such as aluminum polychloride, aluminum polyhydroxide, calcium polysulfide, and the like.

The chelating agent used may be a water-soluble chelating agent. Examples of the chelating agent include oxycarboxylic acids such as tartaric acid, citric acid, gluconic acid, and the like; imino-diacid (IDA), nitrilotriacetic acid (NTA), ethylene diamine tetraacetic acid (EDTA), and the like.

The amount of the chelating agent added is, for example, preferably 0.01 parts by mass or more and 5.0 parts by mass or less and more preferably 0.1 parts by mass or more and less than 3.0 parts by mass relative to 100 parts by mass of the resin particles.

—Fusion/Coalescence—

Next, the aggregated particles are fused and coalesced by, for example, heating the aggregated particle dispersion in which the aggregated particles are dispersed to a temperature equal to or higher than the glass transition temperature of the resin particles (for example, equal to or 10° C. to 30° C. higher than the glass transition temperature of the resin particles), thereby forming the toner particles.

The toner particles are produced by the method described below.

The toner particles may be produced by preparing an aggregated particle dispersion in which the aggregated particles are dispersed, further aggregating the particles so that the resin particles adhere to the surfaces of the aggregated particles by mixing the aggregated particle dispersion with the resin particle dispersion in which the resin particles are dispersed to form second aggregated particles, and fusing and coalescing the second aggregated particles by heating a second aggregated particle dispersion in which the second aggregated particles are dispersed to form toner particles having a core-shell structure.

After the completion of fusion and coalescence, dry toner particles are produced through washing, solid-liquid separation, and drying of the toner particles formed in the solution.

The washing is preferably sufficient displacement washing with ion exchange water from the viewpoint of chargeability. The solid-liquid separation is not particularly limited but is preferably performed by suction filtration, pressure filtration, or the like from the viewpoint of productivity. The drying method is not particularly limited but is preferably freeze drying, flash drying, fluidized drying, vibration-type fluidized drying, or the like from the viewpoint of productivity.

The toner according to the exemplary embodiment is produced by, for example, adding the external additive to the resultant dry toner particles and mixing the mixture. Mixing may be performed by, for example, a V-blender, a Henschel mixer, Lodige mixer, or the like. Further, if required, coarse particles of the toner may be removed by a vibration sieving machine, a wind power sieving machine, or the like.

<Electrostatic Image Developer>

An electrostatic image developer according to an exemplary embodiment of the present invention contains at least the toner according to the exemplary embodiment.

The electrostatic image developer according to the exemplary embodiment may be a one-component developer containing only the toner according to the exemplary embodiment or a two-component developer containing a mixture of the toner and a carrier.

The carrier is not particularly limited and is, for example, a known carrier. Examples of the carrier include a coated carrier produced by coating the surface of a core made of a magnetic powder with a coating resin; a magnetic powder dispersed carrier containing a magnetic powder dispersed and mixed in a matrix resin; a resin-impregnated carrier produced by impregnating a porous magnetic powder with a resin; and the like.

The magnetic powder dispersed carrier and the resin-impregnated carrier may be a carrier produced by coating the constituting particle of the carrier as a core with a coating resin.

Examples of the magnetic powder include powders of magnetic metals such as iron, nickel, cobalt, and the like, magnetic oxides such as ferrite, magnetite, and the like.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, straight silicone resin containing an organosiloxane bond and modified products thereof, fluorocarbon resins, polyester, polycarbonate, phenol resins, epoxy resins, and the like.

The coating resin and matrix resin may contain another additive such as conductive particles or the like.

Examples of the conductive particles include particles of metals such as gold, silver, copper, and the like, carbon black, titanium oxide, zinc oxide, tin oxide, barium sulfate, aluminum borate, potassium titanate, and the like.

A method for coating the core with the coating resin is, for example, a method of coating with a coating layer forming solution in which the coating resin and, if required, various additives are dissolved in a proper solvent. The solvent is not particularly limited and may be selected in consideration of the coating resin used, coatability, etc.

Examples of the resin coating method include a dipping method of dipping the core in the coating layer forming solution, a spray method of spraying the coating layer forming solution on the surface of the core, a fluidized bed method of spraying the coating layer forming solution on the core in a state of being suspended by fluid air, a kneader coater method of mixing the carrier core and the coating layer forming solution in a kneader/coater and removing the solvent, and the like.

The mixing ratio (mass ratio) of the toner to the carrier in the two-component developer is preferably toner:carrier=1:100 to 30:100 and more preferably 3:100 to 20:100.

<Image Forming Apparatus/Image Forming Method>

An image forming apparatus/image forming method according to an exemplary embodiment of the present invention is described.

The image forming apparatus according to the exemplary embodiment includes an image holding member, a charging unit which charges the surface of the image holding member, an electrostatic image forming unit which forms an electrostatic image on the surface of the charged image holding member, a development unit which contains an electrostatic image developer and develops, as a toner image, the electrostatic image formed on the surface of the image holding member with the electrostatic image developer, a transfer unit which transfers the toner image formed on the surface of the image holding member to the surface of a recording medium, a cleaning unit having a cleaning blade which cleans the surface of the image holding member, and a fixing unit which fixes the toner image transferred to the surface of the recording medium. The electrostatic image developer according to the exemplary embodiment is used as the electrostatic image developer.

The image forming apparatus according to the exemplary embodiment performs the image forming method (image forming method according to the exemplary embodiment) including charging the surface of the image holding member, forming an electrostatic image on the surface of the charged image holding member, developing as a toner image, the electrostatic image formed on the surface of the image holding member with the electrostatic image developer according to the exemplary embodiment, transferring the toner image formed on the surface of the image holding member to the surface of a recording medium, cleaning the surface of the image holding member with a cleaning blade, and fixing the toner image transferred to the surface of the recording medium.

Examples of an apparatus used as the image forming apparatus according to the exemplary embodiment include known image forming apparatuses, such as an apparatus of a direct-transfer system in which the toner image formed on the surface of the image holding member is directly transferred to the recording medium, an apparatus of an intermediate-transfer system in which the toner image formed on the surface of the image holding member is first transferred to the surface of an intermediate transfer body, and the toner image transferred to the surface of the intermediate transfer body is second transferred to the surface of the recording medium; an apparatus including an elimination unit which eliminates charge by irradiating the surface of the image holding member with eliminating light before charging after transfer of the toner image, and the like.

In the case of an apparatus of an intermediate-transfer system, a configuration applied to the transfer unit includes, for example, an intermediate transfer body to which the toner image is transferred to the surface, a first transfer unit which transfers the toner image formed on the surface of the image holding member to the surface of the intermediate transfer body, and a second transfer unit which transfers the toner image transferred to the surface of the intermediate transfer body to the surface of the recording medium.

In the image forming apparatus according to the exemplary embodiment, for example, a part including the development unit may be a cartridge structure (process cartridge) which is detachably mounted on the image forming apparatus. The process cartridge used is preferably, for example, a process cartridge including a development unit containing the electrostatic image developer according to the exemplary embodiment.

An example of the image forming apparatus according to the exemplary embodiment is described below, but the image forming apparatus is not limited to this. Further, principal parts shown in the drawings are described, but description of other parts is omitted.

FIG. 1 is a schematic configuration diagram showing an example of the image forming apparatus according to the exemplary embodiment.

An image forming apparatus shown in FIG. 1 includes first to fourth image forming units 10Y, 10M, 10C, and 10K (image forming unit) of an electrophotographic system which output images of colors of yellow (Y), magenta (M), cyan (C), and black (K), respectively, based on color separation image data. The image forming units (simply referred to as "units" hereinafter) 10Y, 10M, 10C, and 10K are disposed in parallel at specific distances therebetween in a horizontal direction. The units 10Y, 10M, 10C, and 10K may be process cartridges detachable from the image forming apparatus.

An intermediate transfer belt 20 is disposed as an intermediate transfer body above the units 10Y, 10M, 10C, and 10K as shown in the drawing so as to pass through the units. The intermediate transfer belt 20 is wound on a driving roll 22 and a support roll 24 in contact with the inner side of the intermediate transfer belt 20, which are disposed at a distance therebetween in the lateral direction of the drawing, so that the intermediate transfer belt 20 moves in a direction from the first unit 10Y to the fourth unit 10K. The support roll 24 is applied with force by a spring or the like (not shown) in a direction away from the driving roll 22, and tension is applied to the intermediate transfer belt 20 wound around both rolls. Also, an intermediate transfer body cleaning device 30 is provided on the image holding side of the intermediate transfer belt 20 so as to face the driving roll 22.

In addition, four color toners of yellow, magenta, cyan, and black contained in toner cartridges 8Y, 8M, 8C, and 8K, respectively, may be supplied to development devices (development units) 4Y, 4M, 4C, and 4K of the units 10Y, 10M, 100, and 10K, respectively.

The first to fourth units 10Y, 10M, 10C, and 10K described above have the same configuration, and thus the first unit 10Y that forms a yellow image and is disposed on the upstream side in the traveling direction of the intermediate transfer belt is described as a representative. The description of the second to fourth units 10M, 10C, and 10K is omitted by adding reference numerals with magenta (M), cyan (C), and black (K) in place of yellow (Y) to portions equivalent to those of the first unit 10Y.

The first unit 10Y includes a photoreceptor 1Y functioning as an image holding member. Around the photoreceptor 1Y, there are sequentially provided a charging roller (an example of the charging unit) 2Y that charges the surface of the photoreceptor 1Y to a predetermined potential, an exposure device (an example of the electrostatic image forming unit) 3 that forms an electrostatic image by exposure of the charged surface with a laser beam 3Y based on an image signal obtained by color separation, a development device (an example of the development unit) 4Y that develops the electrostatic image by supplying a charged toner to the electrostatic image, a first transfer roller 5Y (an example of the first transfer unit) that transfers the developed toner image to the intermediate transfer belt 20, and a photoreceptor cleaning device (an example of the cleaning unit) 6Y that removes the toner remaining on the surface of the photoreceptor 1Y by a cleaning blade 6Y-1 after first transfer.

The first transfer roller 5Y is disposed on the inside of the intermediate transfer belt 20 and is provided at a position opposite to the photoreceptor 1Y. Further, a bias power supply (not shown) is connected to each of the first transfer rollers 5Y, 5M, 5C, and 5K in order to apply a first transfer bias thereto. The transfer bias applied to each of the first transfer rollers from the bias power supply may be changed by a controller (not shown).

An operation of forming a yellow image in the first unit 10Y is described below. First, before the operation, the surface of the photoreceptor 1Y is charged to a potential of about −600 V to −800 V by the charging roller 2Y.

The photoreceptor 1Y is formed by laminating a photosensitive layer on a substrate having conductivity (volume resistivity at 20° C.: $1\times10^{-6}$ Ωcm or less). The photosensitive layer generally has high resistance (equivalent to the resistance of general resins) and has the property of being changed in resistivity in a portion irradiated with a laser beam 3Y when being irradiated with the laser beam 3Y. Therefore, the laser beam 3Y is output to the surface of the charged photoreceptor 1Y through the exposure device 3 according to yellow image data sent from the controller (not shown). The photosensitive layer on the surface of the photoreceptor 1Y is irradiated with the laser beam 3Y, thereby forming an electrostatic image in a yellow image pattern on the surface of the photoreceptor 1Y.

The electrostatic mage is an image formed on the surface of the photoreceptor 1Y by charging and is a so-called negative latent image formed by the charge flowing on the surface of the photoreceptor 1Y due to a decrease in resistivity of an irradiated portion of the photosensitive layer irradiated with the laser beam 3Y and the charge remaining in a portion not irradiated with the laser beam 3Y.

The electrostatic image formed as described above on the photoreceptor 1Y is rotated to a predetermined development position with travel of the photoreceptor 1Y. Then, at the development position, the electrostatic image on the photoreceptor 1Y is visualized as a toner image (developed image) by the development device 4Y.

The development device 4Y contains, for example, an electrostatic image developer containing at least a yellow toner and a carrier. The yellow toner is triboelectrically charged by stirring in the development device 4Y to have charge with the same polarity (negative polarity) as the charge on the photoreceptor 1Y and is held on a developer roller (an example of the developer holding member). When the surface of the photoreceptor 1Y is passed through the development device 4Y, the yellow toner electrostatically adheres to an electrostatically eliminated latent image portion on the surface of the photoreceptor 1Y to develop the latent image with the yellow toner. Then, the photoreceptor 1Y on which the yellow toner image has been formed is continuously traveled at a predetermined speed, and the toner image developed on the photoreceptor 1Y is conveyed to a predetermined first transfer position.

When the yellow toner image on the photoreceptor 1Y is conveyed to the first transfer position, the first transfer bias is applied to the first transfer roller 5Y, and electrostatic force to the first transfer roller 5Y from the photoreceptor 1Y is applied to the toner image, thereby transferring the toner image on the photoreceptor 1Y to the intermediate transfer belt 20. The applied transfer bias has (+) polarity opposite to (−) polarity of the toner and, for example, in the first unit 10Y, the bias is controlled to about +10 μA by the controller (not shown).

Meanwhile, the toner remaining on the photoreceptor 1Y is removed by the photoreceptor cleaning device 6Y and recovered.

Also, the first transfer bias applied to each of the first transfer rollers 5M, 5C, and 5K of the second unit 10M and latter units is controlled according to the first unit 10Y.

Then, the intermediate transfer belt 20 to which the yellow toner image has been transferred in the first unit 10Y is sequentially conveyed through the second to fourth units 10M, 10C, and 10K to superpose the toner images of the respective colors by multi-layer transfer.

The intermediate transfer belt 20 to which the four color toner images have been transferred in multiple layers through the first to fourth units is reached to a second transfer part including the intermediate transfer belt 20, the support roll 24 in contact with the inner side of the intermediate transfer belt 20, and the second transfer roller (an example of the second transfer unit) 26 disposed on the image holding surface side of the intermediate transfer belt 20. Meanwhile, the recording paper (an example of the recording medium) P is fed with predetermined timing, through a feeding mechanism, to a space in which the second transfer roller 26 is in contact with the intermediate transfer belt 20 and a predetermined second transfer bias is applied to the support roll 24. The applied transfer bias has the same polarity (−) as the polarity (−) of the toner and electrostatic force acting toward the recording medium P from the intermediate transfer belt 20 is applied to the toner image to transfer the toner image on the intermediate transfer belt 20 to the recording paper P. The second transfer bias is determined according to the resistance detected by a resistance detector (not shown) that detects the resistance of the second transfer part, and the voltage is controlled.

Then, the recording paper P is sent to a pressure contact part (nit part) between a pair of fixing rollers in a fixing device (an example of the fixing unit) 28 and the toner image is fixed to the recording paper P, forming a fixed image.

Examples of the recording paper to which the toner image is transferred include plain paper used in an electrophotographic copying machine, a printer, and the like. Besides the recording paper P, an OHP sheet and the like can be used as the recording medium.

In order to further improve the surface smoothness of the image after fixing, the recording paper P preferably has a smooth surface. For example, coated paper including plain paper a surface of which is coated with a resin or the like, art paper for printing, and the like may be used.

The recording paper P after the completion of fixing of the color image is conveyed to a discharge part, and a series of color image forming operations is finished.

<Process Cartridge/Toner Cartridge>

A process cartridge according to an exemplary embodiment of the present invention is described.

The process cartridge according to the exemplary embodiment is a process cartridge detachably mounted on the image forming apparatus and including a development unit which contains the electrostatic image developer according to the exemplary embodiment and develops as the toner imager the electrostatic image formed on the image holding member.

The process cartridge according to the exemplary embodiment is not limited to the configuration described above, and may have a configuration including a development device and, if required, for example, at least one selected from other units such as an image holding member, a charging unit, an electrostatic image forming unit, and a transfer unit, etc.

An example of the process cartridge according to the exemplary embodiment is described below, but the process cartridge is not limited to this. Further, principal parts shown in the drawings are described, but description of other parts is omitted.

Figure 2:
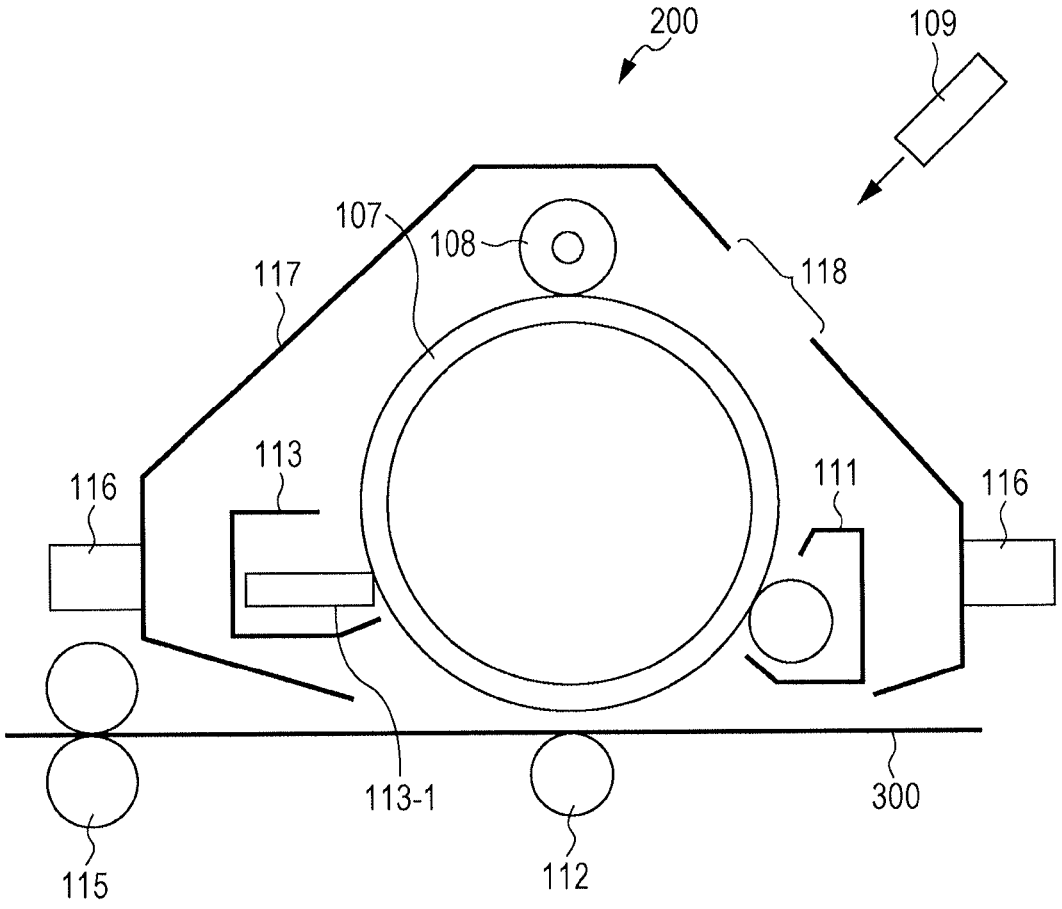
FIG. 2 is a schematic configuration diagram showing an example of a process cartridge according to an exemplary embodiment of the present invention.

FIG. 2 is a schematic configuration diagram showing the process cartridge according to the exemplary embodiment.

A process cartridge 200 shown in FIG. 2 is a cartridge with a configuration in which a photoreceptor 107 (an example of the image holding member) and a charging roller 108 (an example of the charging unit), a development device 111 (an example of the development unit), and a photoreceptor cleaning device 113 (an example of the cleaning unit), which are provided around the photoreceptor 107, are integrally held in combination by a mounting rail 116 and a housing 117 provided with an opening 118 for exposure.

In FIG. 2, reference numeral 109 denotes an exposure device (an example of the electrostatic image forming unit), reference numeral 112 denotes a transfer device (an example of the transfer unit), reference numeral 115 denotes a fixing device (an example of the fixing unit), and reference numeral 300 denotes recording paper (an example of the recording medium).

Next, a toner cartridge according to an exemplary embodiment of the present invention is described.

The toner cartridge according to the exemplary embodiment is a toner cartridge containing the toner according to the exemplary embodiment and detachable from the image forming apparatus. The toner cartridge is intended to contain the toner for replenishment to supply the toner to the development unit provided in the image forming apparatus.

The image forming apparatus shown in FIG. 1 is an image forming apparatus having a configuration in which toner cartridges 8Y, 8M, 8C, and 8B are detachably provided and are connected to the corresponding development devices (colors) 4Y, 4M, and 4B through supply tubes (not shown). When the amount of the toner contained in the toner cartridge is decreased, the toner cartridge is exchanged.

EXAMPLES

Exemplary embodiments are described in further detail below by giving examples, but the exemplary embodiments are not limited to these examples. In the description below, "parts" and "%" represent "parts by mass" and "% by mass", respectively, unless particularly specified.

[Production of Toner Particles]

(Production of Toner Particles (1))

—Preparation of Polyester Resin Particle Dispersion (1)—

Ethylene glycol [manufactured by Wako Pure Chemical Industries, Ltd.]: 37 parts

Neopentyl glycol [manufactured by Wako Pure Chemical Industries, Ltd.]: 65 parts 1,9-Nonanediol [manufactured by Wako Pure Chemical Industries, Ltd.]: 32 parts Terephthalic acid [manufactured by Wako Pure Chemical Industries, Ltd.]: 96 parts The monomers described above are added to a flask and heated to a temperature of 200° C. over 1 hour, and 1.2 parts of dibutyltin oxide is added after stirring in the reaction system is confirmed. Further, the temperature is increased to 240° C. over 6 hours while the water produced is distilled off, and dehydration condensation reaction is further continued at 240° C. for 4 hours. As a result, polyester resin A having an acid value of 9.4 mgKOH/g, a weight-average molecular weight of 13,000, and a glass transition temperature of 62° C. is produced.

Next, the polyester resin A in a molten state is transferred to Cavitron CD1010 (manufactured by Eurotec Co., Ltd.) at a rate of 100 parts/min. Then, diluted ammonia water at a concentration of 0.37% prepared by diluting reagent ammonia water with ion exchange water is placed in an aqueous medium tank separately prepared and is transferred, together with the polyester resin melt, to the Cavitron at a rate of 0.1 L/min while being heated to 120° C. by a heat exchanger. The Cavitron is operated under the conditions of a rotor rotational speed of 60 Hz and a pressure of 5 kg/cm$^2$, thereby producing a polyester resin particle dispersion (1) in which resin particles having a volume-average particle diameter of 160 nm, a solid content of 30%, a glass transition temperature of 62° C., and a weight-average molecular weight Mw of 13,000 are dispersed.

—Preparation of Coloring Agent Particle Dispersion—

Cyan pigment [Pigment Blue 15:3, manufactured by Dainichiseika Color & Chemicals Mfg. Co., Ltd.]: 10 parts Anionic surfactant (Neogen SC, manufactured by Daiichi Kogyo Seiyaku Co., Ltd.): 2 parts Ion exchange water: 80 parts These components are mixed and dispersed by a high-pressure collision-type disperser Ultimaizer [HJP30006, manufactured by Sugino Machine Ltd.) for 1 hour to prepare a coloring agent particle dispersion having a volume-average particle diameter of 180 nm and a solid content of 20%.

—Mold Release Agent Particle Dispersion—

Carnauba wax (RC-160, melting temperature of 84° C., manufactured by Toakasei Co., Ltd,): 50 parts Anionic surfactant (Neogen SC, manufactured by Daiichi Kogyo Seiyaku C., Ltd.): 2 parts Ion exchange water: 200 parts These components are heated to 120° C. and then mixed and dispersed by using Ultra-Turrax T50 manufactured by IKA Corporation and then dispersed by using a pressure ejection-type homogenizer to produce a mold release agent particle dispersion having a volume-average particle diameter of 200 nm and a solid content of 20%.

—Production of toner particles (1)—

Polyester resin particle dispersion (1): 200 parts

Coloring agent particle dispersion: 25 parts

Mold release agent particle dispersion 30 parts

Aluminum polychloride: 0.5 parts

Ion exchange water: 100 parts

These components are placed in a stainless flask, mixed and dispersed by Ultra-Turrax manufactured by IKA Corporation, and then heated to 46° C. under stirring in the flask in a heating oil bath. After the mixture is maintained at 46° C. for 30 minutes, 70 parts of the polyester resin particle dispersion (1) is added.

Then, the system is adjusted to pH 8.0 with an aqueous sodium hydroxide solution at a concentration of 0.5 mol/L, and then the stainless flask is closed. Then, the mixture is heated to 86° C. while stirring is continued with a magnetic force seal of a stirring shaft and then maintained for 5 hours. After the completion of reaction, the reaction product is cooled at a temperature drop rate of 2° C./min, filtered, and washed with ion exchange water, followed by solid-liquid separation by Nutsche-type suction filtration. Further, the separated solid is again dispersed in 3 L of ion exchange water of 30° C., and stirred and washed at 300 rpm for 15 minutes. This washing operation is repeated 6 times, and when the filtrate has a pH of 7.54 and an electric conductivity of 6.5 μS/cm, solid-liquid separation is performed by Nutsche-type suction filtration using No. 5A filter paper. Then, vacuum drying is continued for 12 hours to produce toner particles (1).

The resultant toner particles (1) have a volume-average particle diameter D50v of 4.8 μm, and an average circularity of 0.964.

—Production of toner particles (2)—

Polyester resin particle dispersion (1): 200 parts

Coloring agent particle dispersion: 25 parts

Mold release agent particle dispersion 30 parts

Aluminum polychloride: 0.4 parts

Ion exchange water: 100 parts

These components are placed in a stainless flask, mixed and dispersed by Ultra-Turrax manufactured by IKA Corporation, and then heated to 48° C. under stirring in the flask in a heating oil bath. After the mixture is maintained at 48° C. for 30 minutes, 70 parts of the polyester resin particle dispersion (1) is added.

Then, the system is adjusted to pH 8.0 with an aqueous sodium hydroxide solution at a concentration of 0.5 mol/L, and then the stainless flask is closed. Then, the mixture is heated to 90° C. while stirring is continued with a magnetic force seal of a stirring shaft and then maintained for 8 hours. After the completion of reaction, the reaction product is cooled at a temperature drop rate of 2° C./min, filtered, and washed with ion exchange water, followed by solid-liquid separation by Nutsche-type suction filtration. Further, the separated solid is again dispersed in 3 L of ion exchange water of 30° C., and stirred and washed at 300 rpm for 15 minutes. This washing operation is repeated 6 times, and when the filtrate has a pH of 7.54 and an electric conductivity of 6.5 μS/cm, solid-liquid separation is performed by Nutsche-type suction filtration using No. 5A filter paper. Then, vacuum drying is continued for 12 hours to produce toner particles (2).

The resultant toner particles (2) have a volume-average particle diameter D50v of 5.8 μm, and an average circularity of 0.982.

—Production of Toner Particles (3)—

Polyester resin particle dispersion (1): 200 parts
Coloring agent particle dispersion: 25 parts
Mold release agent particle dispersion 30 parts
Aluminum polychloride: 0.4 parts
Ion exchange water: 100 parts These components are placed in a stainless flask, mixed and dispersed by Ultra-Turrax manufactured by IKA Corporation, and then heated to 48° C. under stirring in the flask in a heating oil bath. After the mixture is maintained at ° C. for 30 minutes, 70 parts of the polyester resin particle dispersion (1) is added.

Then, the system is adjusted to pH 8.7 with an aqueous sodium hydroxide solution at a concentration of 0.5 mol/L, and then the stainless flask is closed. Then, the mixture is heated to 85° C. while stirring is continued with a magnetic force seal of a stirring shaft and then maintained for 6 hours. After the completion of reaction, the reaction product is cooled at a temperature drop rate of 2° C./min, filtered, and washed with ion exchange water, followed by solid-liquid separation by Nutsche-type suction filtration. Further, the separated solid is again dispersed in 3 L of ion exchange water of 30° C., and stirred and washed at 300 rpm for 15 minutes. This washing operation is repeated 6 times, and when the filtrate has a pH of 7.54 and an electric conductivity of 6.5 μS/cm, solid-liquid separation is performed by Nutsche-type suction filtration using No. 5A filter paper. Then, vacuum drying is continued for 12 hours to produce toner particles (3).

The resultant toner particles (3) have a volume-average particle diameter D50v of 5.9 μm, and an average circularity of 0.948.

[Production of Silica Particles]

(Preparation of Silica Particle Dispersion (1))

In a 1.5 L glass-made reactor provided with a stirrer, a dropping nozzle, and a thermometer, 300 parts of methanol and 70 parts of 10% ammonia water are added and mixed to prepare an alkali catalyst solution.

The alkali catalyst solution is adjusted to 30° C., and 185 parts of tetramethoxysilane and 50 parts of 8.0% ammonia water are simultaneously added dropwisely under stirring to prepare a hydrophilic silica particle dispersion (solid content: 12.0%). The dropping time is 30 minutes.

Then, the resultant silica particle dispersion is concentrated by a rotary filter R-fine (manufactured by Cotobuki Kogyo Co., Ltd.) to a solid concentration of 40%. The concentrated dispersion is used as a silica particle dispersion (1).

(Preparation of Silica Particle Dispersions (2) to (8))

Silica particle dispersions (2) to (8) are prepared by the same method as for the silica particle dispersion (1) except that in preparing the silica particle dispersion (1), the alkali catalyst solution (an amount of methanol and an amount of 10% ammonia water) and silica particle production conditions (the total amount of tetramethoxysilane (denoted as TMOS) and 8% ammonia water dropped to the alkali catalyst solution and the dropping time) are changed according to Table 1.

The details of the silica particle dispersions (1) to (8) are summarized in Table 1.

TABLE 1

| | Alkali catalyst solution | | Silica particle production condition | | |
|---|---|---|---|---|---|
| | | | TMOS | 8% ammonia | |
| Silica particle dispersion | Methanol (parts) | 10% ammonia water (parts) | total dropping amount (parts) | water total dropping amount (parts) | Dropping time |
| (1) | 300 | 70 | 185 | 50 | 30 min |
| (2) | 300 | 70 | 340 | 92 | 55 min |
| (3) | 300 | 46 | 40 | 25 | 30 min |
| (4) | 300 | 70 | 62 | 17 | 10 min |
| (5) | 300 | 70 | 700 | 200 | 120 min |
| (6) | 300 | 70 | 500 | 140 | 85 min |
| (7) | 300 | 70 | 1000 | 280 | 170 min |
| (8) | 300 | 70 | 3000 | 800 | 520 min |

(Production of Surface-Treated Silica Particles (S1))

Silica particles are surface-treated with a siloxane compound in an atmosphere of supercritical carbon dioxide using the silica particle dispersion (1) as follows. Surface treatment is performed by using an apparatus provided with a carbon dioxide cylinder, a carbon dioxide pump, an entrainer pump, an autoclave with a stirrer (volume 500 ml), and a pressure valve.

First, in the autoclave (volume: 500 ml) with a stirrer, 250 parts of the silica particle dispersion (1) is added and the stirrer is rotated at 100 rpm. Then, liquefied carbon dioxide is injected into the autoclave, and the pressure in the autoclave is increased by the carbon dioxide pump under heating with a heater, thereby creating a supercritical state of 150° C. and 15 MPa in the autoclave. Then, supercritical carbon dioxide is circulated by the carbon dioxide pump while the pressure in the autoclave is kept at 15 MPa by the pressure valve to remove methanol and water from the silica particle dispersion (1) (solvent removal), thereby producing silica particles (untreated silica particles).

Next, when the amount (accumulated amount: measured as an amount of carbon dioxide circulated in a standard state) of the supercritical carbon dioxide circulated is 900 parts, the circulation of supercritical carbon dioxide is stopped.

Then, the supercritical state of carbon dioxide is maintained in the autoclave while the pressure is kept at 15 MPa by the carbon dioxide pump the temperature is kept at 150° C. by the heater. In this state, a treatment agent solution, which is previously prepared by dissolving 0.3 parts of dimethyl silicone oil (DSO: trade name "KF-96 (manufactured by Shin-Etsu Chemical Co., Ltd.)") having a viscosity of 10,000 cSt and used as a siloxane compound in 20 parts by hexamethyldisilazane (HMDS: manufactured by Yuki Gosei Kogyo Co., Ltd.) as a hydrophobizing agent, is introduced into 100 parts of the silica particles (untreated silica particles) in the autoclave using the entrainer pump, followed by reaction at 180° C. for 20 minutes under stirring. Then, supercritical carbon dioxide is again circulated to remove an excess of the treatment agent solution. Then, stirring is stopped, the pressure in the autoclave is released to the atmospheric pressure by opening the pressure valve, and the temperature is decreased to room temperature (25° C.)

As described above, solvent removal and surface treatment with the siloxane compound are sequentially performed to produce surface-treated silica particles (S1).

(Production of Surface-Treated Silica Particles (S2) to (S5), (S7) to (S9), and (S12) to (S17))

Surface-treated silica particles (S2) to (S5), (S7) to (S9), and (S12) to (S17) are produced by the same method as for the surface-treated silica particles (S1) except that in producing the surface-treated silica particles (S1), the silica particle dispersion, surface treatment conditions (treatment atmosphere, siloxane compound (type, viscosity, and adding amount), and the hydrophobizing agent and adding amount thereof) are changed according to Table 2.

(Production of Surface-Treated Silica Particles (S6))

Silica particles are surface-treated with a siloxane compound in the air atmosphere by using the same dispersion as the silica particle dispersion (1) used for producing the surface-treated silica particles (S1) as follows.

An ester adaptor and a condenser are attached to the reactor used for producing the silica particle dispersion (1), and methanol is distilled off by heating the silica particle dispersion (1) within a range of 60° C. to 70° C. Then, water is added, and methanol is further distilled off by heating within a range of 70° C. to 90° C. to produce an aqueous dispersion of silica particles. Then, 3 parts of methyl trimethoxysilane (MTMS: manufactured by Shin-Etsu Chemical Co., Ltd.) is added to 100 parts of silica particles in the aqueous dispersion at room temperature (20° C.) and reacted for 2 hours, thereby treating the surfaces of the silica particles. Then, methyl isobutyl ketone is added to the surface treatment dispersion, and methanol and water are distilled off by heating within a range of 80° C. to 110° C. Then, 80 parts of hexamethyldisilazane (HMDS: manufactured by Yuki Gosei Kogyo Co., Ltd.) and 1.0 part of dimethyl silicone oil (DSO: trade name "KF-96 (manufactured by Shin-Etsu Chemical Co., Ltd.)") having a viscosity or 10,000 cSt and used as a siloxane compound are added to 100 parts of the silica particles in the resultant dispersion at room temperature (20° C.), followed by reaction at 120° C. for 3 hours. After cooling, the silica particles are dried by spray drying to produce surface-treated silica particles (S6).

(Production of Surface-Treated Silica Particles (S10))

Surface-treated silica particles (S10) are produced by the same method as for the surface-treated silica particles (S1) except that fumed silica OX50 (AEROSIL OX50 manufactured by Nippon Aerosil Co., Ltd.) is used in place of the silica particle dispersion (1). That is, 100 parts of OX50 is added to the same autoclave with a stirrer as for producing the surface-treated silica particles (S1), and the stirrer is rotated at 100 rpm. Then, liquefied carbon dioxide is introduced into the autoclave, and the pressure in the autoclave is increased by the carbon dioxide pump while heating with the heater, to create a supercritical state of 180° C. and 15 MPa in the autoclave. Then, in a state in which the pressure in the autoclave is kept at 15 MPa by the pressure valve, a treatment agent solution previously prepared by dissolving 0.3 parts of dimethyl silicone oil (DSO: trade name "KF-96 (manufactured by Shin-Etsu Chemical Co., Ltd.)") having a viscosity of 10,000 cSt and used as a siloxane compound in 20 parts of hexamethyldisilazane (HMDS: manufactured by Yuki Gosei Kogyo Co., Ltd.) as a hydrophobizing agent is introduced into the autoclave using the entrainer pump, followed by reaction at 180° C. for 20 minutes under stirring. Then, supercritical carbon dioxide is circulated to remove an excess of the treatment agent solution, thereby producing surface-treated silica particles (S10).

(Production of Surface-Treated Silica Particles (S11))

Surface-treated silica particles (S11) are produced by the same method as for the surface-treated silica particles (S1) except that fumed silica A50 (AEROSL A50 manufactured by Nippon Aerosil Co., Ltd.) is used in place of the silica particle dispersion (1). That is, 100 parts of A50 is added to the same autoclave with a stirrer as for producing the surface-treated silica particles (S1), and the stirrer is rotated at 100 rpm. Then, liquefied carbon dioxide is introduced into the autoclave, and the pressure in the autoclave is increased by the carbon dioxide pump while heating with the heater to create a supercritical state of 180° C. and 15 MPa in the autoclave. Then, in a state in which the pressure in the autoclave is kept at 15 MPa by the pressure valve, a treatment agent solution previously prepared by dissolving 1.0 part of dimethyl silicone oil (DSO: trade name "KF-96" (manufactured by Shin-Etsu Chemical Co., Ltd.)) having a viscosity of 10,000 cSt and used as a siloxane compound in 40 parts of hexamethyldisilazane (HMDS: manufactured by Yuki Gosei Kogyo Co., Ltd.) as a hydrophobizing agent is introduced into the autoclave using the entrainer pump, followed by reaction at 180° C. for 20 minutes under stirring. Then, supercritical carbon dioxide is circulated to remove an excess of the treatment agent solution, thereby producing surface-treated silica particles (S11).

(Production of Surface-Treated Silica Particles (SC1))

Surface-treated silica particles (SC1) are produced by the same method as for the surface-treated silica particles (S1) except that in producing the surface-treated silica particles (S1), the siloxane compound is not added.

(Production of Surface-Treated Silica Particles (SC2) to (SC4)

Surface-treated silica particles (SC2) to (SC4) are produced by the same method as for the surface-treated silica particles (S1) except that in producing the surface-treated silica particles (S1), the silica particle dispersion and surface treatment conditions (treatment atmosphere, siloxane compound (type, viscosity, and adding amount), and the hydrophobizing agent and adding amount thereof) are changed according to Table 3.

(Production of Surface-Treated Silica Particles (SC5))

Surface-treated silica particles (SC5) are produced by the same method as for the surface-treated silica particles (S6) except that in producing the surface-treated silica particles (S6), the siloxane compound is not added.

(Production of Surface-Treated Silica Particles (SC6))

Surface-treated silica particles (SC6) are produced by filtering the silica particle dispersion (6), drying the residue at 120° C. and then firing at 400° C. for 6 hours in an electric furnace, and spraying 10 parts of HMDS on 100 parts of the silica particles and drying the silica particles by spray-dry.

(Physical Properties of Surface-Treated Silica Particles)

The obtained surface-treated silica particles are measured by methods described below with respect to the average equivalent circle diameter, average circularity, amount of siloxane compound adhering to the untreated silica particles (in the tables, "Surface adhesion amount"), compression-aggregation degree, particle compression ratio, and particle dispersion degree.

Hereinafter, a list of details of the surface-treated silica particles is shown in Table 2 to Table 5. In Table 2 to Table 5, abbreviations are as follows.

DSO: Dimethyl silicone oil

HMDS: Hexamethyldisilazane

TABLE 2

| Surface-treated silica particle | Silica particle dispersion | Surface treatment condition: Siloxane compound: Type | Viscosity (cSt) | Adding amount (parts) | Treatment atmosphere | Hydrophobizing agent/parts |
|---|---|---|---|---|---|---|
| (S1) | (1) | DSO | 10000 | 0.3 parts | Supercritical $CO_2$ | HMDS/20 parts |
| (S2) | (1) | DSO | 10000 | 1.0 part | Supercritical $CO_2$ | HMDS/20 parts |
| (S3) | (1) | DSO | 5000 | 0.15 parts | Supercritical $CO_2$ | HMDS/20 parts |
| (S4) | (1) | DSO | 5000 | 0.5 parts | Supercritical $CO_2$ | HMDS/20 parts |
| (S5) | (2) | DSO | 10000 | 0.2 parts | Supercritical $CO_2$ | HMDS/20 parts |
| (S6) | (1) | DSO | 10000 | 1.0 part | Atmospheric | HMDS/80 parts |
| (S7) | (3) | DSO | 10000 | 0.3 parts | Supercritical $CO_2$ | HMDS/20 parts |
| (S8) | (4) | DSO | 10000 | 0.3 parts | Supercritical $CO_2$ | HMDS/20 parts |
| (S9) | (1) | DSO | 50000 | 1.5 parts | Supercritical $CO_2$ | HMDS/20 parts |
| (S10) | Fumed silica OX50 | DSO | 10000 | 0.3 parts | Supercritical $CO_2$ | HMDS/20 parts |
| (S11) | Fumed silica A50 | DSO | 10000 | 1.0 part | Supercritical $CO_2$ | HMDS/40 parts |
| (S12) | (3) | DSO | 5000 | 0.04 parts | Supercritical $CO_2$ | HMDS/20 parts |
| (S13) | (3) | DSO | 1000 | 0.5 parts | Supercritical $CO_2$ | HMDS/20 parts |
| (S14) | (3) | DSO | 10000 | 5.0 parts | Supercritical $CO_2$ | HMDS/20 parts |
| (S15) | (5) | DSO | 10000 | 0.5 parts | Supercritical $CO_2$ | HMDS/20 parts |
| (S16) | (6) | DSO | 10000 | 0.5 parts | Supercritical $CO_2$ | HMDS/20 parts |
| (S17) | (7) | DSO | 10000 | 0.5 parts | Supercritical $CO_2$ | HMDS/20 parts |

TABLE 3

| Surface-treated silica particle | Silica particle dispersion | Surface treatment condition: Siloxane compound: Type | Viscosity (cSt) | Adding amount (parts) | Treatment atmosphere | Hydrophobizing agent/parts |
|---|---|---|---|---|---|---|
| (SC1) | (1) | — | — | — | Supercritical $CO_2$ | HMDS/20 parts |
| (SC2) | (1) | DSO | 100 | 3.0 parts | Supercritical $CO_2$ | HMDS/20 parts |
| (SC3) | (1) | DSO | 1000 | 8.0 parts | Supercritical $CO_2$ | HMDS/20 parts |
| (SC4) | (3) | DSO | 3000 | 10.0 parts | Supercritical $CO_2$ | HMDS/20 parts |
| (SC5) | (1) | — | — | — | Atmospheric | HMDS/80 parts |
| (SC6) | (8) | — | — | — | Atmospheric | HMDS/10 parts |

TABLE 4

| Surface-treated silica particle | Silica particle dispersion | Characteristic of surface-treated silica particle: Average equivalent circle diameter (nm) | Average circularity | Surface adhesion amount (% by mass) | Compression-aggregation degree (%) | Particle compression ratio | Particle dispersion degree (%) |
|---|---|---|---|---|---|---|---|
| (S1) | (1) | 120 | 0.958 | 0.28 | 85 | 0.310 | 98 |
| (S2) | (1) | 120 | 0.958 | 0.98 | 92 | 0.280 | 97 |
| (S3) | (1) | 120 | 0.958 | 0.12 | 80 | 0.320 | 99 |
| (S4) | (1) | 120 | 0.958 | 0.47 | 88 | 0.295 | 98 |
| (S5) | (2) | 140 | 0.962 | 0.19 | 81 | 0.360 | 99 |
| (S6) | (1) | 120 | 0.958 | 0.50 | 83 | 0.380 | 93 |
| (S7) | (3) | 130 | 0.850 | 0.29 | 68 | 0.350 | 92 |
| (S8) | (4) | 90 | 0.935 | 0.29 | 94 | 0.390 | 95 |
| (S9) | (1) | 120 | 0.958 | 1.25 | 95 | 0.240 | 91 |
| (S10) | Fumed silica OX50 | 80 | 0.680 | 0.26 | 84 | 0.395 | 92 |
| (S11) | Fumed silica A50 | 45 | 0.880 | 0.91 | 88 | 0.276 | 91 |
| (S12) | (3) | 130 | 0.850 | 0.02 | 62 | 0.360 | 96 |
| (S13) | (3) | 130 | 0.850 | 0.46 | 90 | 0.380 | 92 |
| (S14) | (3) | 130 | 0.850 | 4.70 | 95 | 0.360 | 91 |
| (S15) | (5) | 185 | 0.971 | 0.43 | 61 | 0.209 | 96 |
| (S16) | (6) | 164 | 0.97 | 0.41 | 64 | 0.224 | 97 |
| (S17) | (7) | 210 | 0.978 | 0.44 | 60 | 0.205 | 98 |

TABLE 5

| Surface-treated silica particle | Characteristic of surface-treated silica particle | | | | | |
|---|---|---|---|---|---|---|
| | Average equivalent circle diameter (nm) | Average circularity | Surface adhesion amount (% by mass) | Compression-aggregation degree (%) | Particle compression ratio | Particle dispersion degree (%) |
| (SC1) | 120 | 0.958 | — | 55 | 0.415 | 99 |
| (SC2) | 120 | 0.958 | 2.5 | 98 | 0.450 | 75 |
| (SC3) | 120 | 0.958 | 7.0 | 99 | 0.360 | 83 |
| (SC4) | 130 | 0.850 | 8.5 | 99 | 0.380 | 85 |
| (SC5) | 120 | 0.958 | — | 62 | 0.425 | 98 |
| (SC6) | 300 | 0.980 | — | 60 | 0.197 | 93 |

[Production of PTFE Particles]

—Production of PTFE Particles 1—

In an autoclave provided with a stainless-made anchor-type stirring blade and a jacket for temperature control, deionized water, ammonium perfluorooctanoate, and paraffin wax are added, and the inside of the system is replaced with nitrogen gas and tetrafluoroethylene (hereinafter referred to as "TFE") under heating. Then, TFE is injected, and the internal temperature is kept at 80 C under stirring at 250 rpm. Further, TFE is supplied so that the internal pressure in the autoclave becomes constant while an aqueous solution of ammonium persulfate and an aqueous solution of disuccinic acid peroxide are injected. After stirring is continued for 60 minutes from the start of polymerization, the supply of TFE and stirring is stopped to terminate reaction. Then, an aqueous solution of ammonium hydroperfluorononanoate is injected into the resultant latex, and the temperature in the system is adjusted to 50° C. by adding hot water. Next, nitric acid is added and, at the same time, coagulation is started at a stirring speed of 250 rpm to separate a polymer from water, followed by stirring for 1 hour. Then, water is removed, and the residue is dried to produce PTFE particles 1 having a number-average particle diameter of 350 nm.

—Production of PTFE Particles 2—

PTFE particles 2 having a number-average particle diameter of 100 nm are produced by the same method as for the PTFE particles 1 except that in producing the PTFE particles 1, stirring is continued for 40 minutes from the start of polymerization, and the stirring speed during coagulation is 500 rpm.

—Production of PTFE Particles 3—

PTFE particles 3 having a number-average particle diameter of 500 nm are produced by the same method as for the PTFE particles 1 except that in producing the PTFE particles 1, stirring is continued for 90 minutes from the start of polymerization, and the stirring speed during coagulation is 100 rpm.

—Production of PTFE particles 4—

PTFE particles 4 having a number-average particle diameter of 800 nm are produced by the same method as for the PTFE particles 1 except that in producing the PTFE particles 1, stirring is continued for 150 minutes from the start of polymerization, and the stirring speed during coagulation is 500 rpm.

Examples 1 to 26 and Comparative Examples 1 to 7

A toner of each of examples is produced by adding a number of parts of silica particles and a number of parts of PTFE particles shown in Table 6 and Table 7 to 100 parts of toner particles shown in Table 6 and Table 7, and then mixing the resultant mixture with a Henschel mixer at 2000 rpm for 3 minutes.

Each of the toners and a carrier are placed at a toner/carrier ratio (mass ratio) of 5:95 in a V-blender and then stirred for 20 minutes to produce a developer.

The carrier used is produced as follows.

Ferrite particles (volume-average particle diameter: 50 μm): 100 parts

Toluene: 14 parts

Styrene-methyl methacrylate copolymer: 2 parts (component ratio: 90/10, Mw=80000)

Carbon black (R330: manufactured by Cabot Corporation): 0.2 parts

First, the components excepting the ferrite particles are stirred by a stirrer for 10 minutes to prepare a dispersed coating solution. Next, the coating solution and the ferrite particles are placed in a vacuum degassing kneader and stirred at 60° C. for 30 minutes, and then further degassing is performed by pressure reduction under heating. The product is dried to produce the carrier.

[Evaluation]

The occurrence of image deletion of a toner image is evaluated for the developer produced in each of the examples. The results are shown in Table 6 and Table 7.

(Evaluation of Image Deletion)

A development unit of an image forming apparatus "Fuji Xerox Docu Centre Color 400" is filled with the developer produced in each of the examples. A solid image with an area coverage of 100% is formed on 10,000 sheets by using the image forming apparatus in an environment of a temperature of 30° C. and a humidity of 85% RH, followed by allowing to stand. On the next day, a degree of image deletion in a solid image with an area coverage of 100% is evaluated. The image deletion can be measured by density measurement using X-ritte 404. The density is measured at 5 points in the plane of a chart with an area coverage of 100%, and a density difference of 0.1 or more is evaluated as "problem". Image output is continued until image deletion becomes unable to be confirmed, and image deletion is evaluated by the number of sheets when the image deletion becomes unable to be confirmed. The same operation is performed for every 10,000 sheets until 30,000 sheets.

G5: Image deletion cannot be confirmed.

G4: Image deletion can be confirmed but cannot be confirmed at the 2nd sheet.

G3: Image deletion can be confirmed but cannot be confirmed at the 3rd to 5th sheet.

G2: Image deletion can be confirmed but cannot be confirmed at the 6th to 9th sheet.

G1: Image deletion can be confirmed even at the 10th sheet.

When "G2" is obtained at the end of 30,000 sheets, image deletion is determined as "allowable".

TABLE 6

| | Developer | | | | | Evaluation of image deletion | | | |
|---|---|---|---|---|---|---|---|---|---|
| | Toner | Surface-treated silica particle | | PTFE particle | | | 10000 | 20000 | 30000 |
| | particle | Type | Parts | Type | Parts | Initial | sheets | sheets | sheets |
| Example 1 | (2) | (S1) | 2 | (1) | 0.2 | G5 | G5 | G5 | G5 |
| Example 2 | (2) | (S2) | 2 | (1) | 0.2 | G5 | G5 | G5 | G5 |
| Example 3 | (2) | (S3) | 2 | (1) | 0.2 | G5 | G5 | G5 | G5 |
| Example 4 | (2) | (S4) | 2 | (1) | 0.2 | G5 | G5 | G5 | G5 |
| Example 5 | (2) | (S5) | 2 | (1) | 0.2 | G5 | G5 | G5 | G5 |
| Example 6 | (2) | (S6) | 2 | (1) | 0.2 | G5 | G5 | G4 | G4 |
| Example 7 | (2) | (S7) | 2 | (1) | 0.2 | G5 | G5 | G5 | G4 |
| Example 8 | (2) | (S8) | 2 | (1) | 0.2 | G5 | G5 | G4 | G3 |
| Example 9 | (2) | (S9) | 2 | (1) | 0.2 | G5 | G5 | G5 | G4 |
| Example 10 | (2) | (S10) | 2 | (1) | 0.2 | G5 | G5 | G4 | G4 |
| Example 11 | (2) | (S11) | 2 | (1) | 0.2 | G5 | G5 | G4 | G4 |
| Example 12 | (2) | (S12) | 2 | (1) | 0.2 | G5 | G5 | G5 | G4 |
| Example 13 | (2) | (S13) | 2 | (1) | 0.2 | G5 | G5 | G4 | G3 |
| Example 14 | (2) | (S14) | 2 | (1) | 0.2 | G5 | G5 | G5 | G5 |
| Example 15 | (2) | (S15) | 2 | (1) | 0.2 | G5 | G4 | G3 | G2 |
| Example 16 | (2) | (S16) | 2 | (1) | 0.2 | G5 | G4 | G3 | G2 |
| Example 17 | (2) | (S17) | 2 | (1) | 0.2 | G5 | G4 | G3 | G2 |
| Example 18 | (1) | (S1) | 2 | (1) | 0.2 | G5 | G5 | G5 | G4 |
| Example 19 | (3) | (S1) | 2 | (1) | 0.2 | G5 | G5 | G4 | G3 |
| Example 20 | (2) | (S1) | 0.08 | (1) | 0.2 | G5 | G5 | G5 | G4 |
| Example 21 | (2) | (S1) | 0.25 | (1) | 0.2 | G5 | G5 | G5 | G5 |
| Example 22 | (2) | (S1) | 4.2 | (1) | 0.2 | G5 | G5 | G5 | G5 |
| Example 23 | (2) | (S1) | 6.1 | (1) | 0.2 | G5 | G5 | G4 | G4 |
| Example 24 | (2) | (S1) | 2 | (2) | 0.2 | G5 | G5 | G5 | G4 |
| Example 25 | (2) | (S1) | 2 | (3) | 0.2 | G5 | G5 | G5 | G4 |
| Example 26 | (2) | (S1) | 2 | (4) | 0.2 | G5 | G5 | G4 | G3 |

TABLE 7

| | Developer | | | | | Evaluation of image deletion | | | |
|---|---|---|---|---|---|---|---|---|---|
| | Toner | Surface-treated silica particle | | PTFE particle | | | 10000 | 20000 | 30000 |
| | particle | Type | Parts | Type | Parts | Initial | sheets | sheets | sheets |
| Comparative Example 1 | (2) | (SC1) | 2 | (1) | 0.2 | G5 | G3 | G2 | G1 |
| Comparative Example 2 | (2) | (SC2) | 2 | (1) | 0.2 | G5 | G3 | G2 | G1 |
| Comparative Example 3 | (2) | (SC3) | 2 | (1) | 0.2 | G5 | G3 | G2 | G1 |
| Comparative Example 4 | (2) | (SC4) | 2 | (1) | 0.2 | G5 | G3 | G2 | G1 |
| Comparative Example 5 | (2) | (SC5) | 2 | (1) | 0.2 | G5 | G3 | G2 | G1 |
| Comparative Example 6 | (2) | (SC6) | 2 | (1) | 0.2 | G5 | G2 | G1 | G1 |
| Comparative Example 7 | (2) | (S1) | 2 | — | — | G5 | G2 | G1 | G1 |

The results described above indicate that in the examples, the occurrence of image deletion is suppressed as compared with the comparative examples.

In particular, in Examples 1 to 5 and 14 each of which uses as an external additive the silica particles having a compression-aggregation degree of 70% or more and 95% or less and a particle compression ratio of 0.28 or more and 0.36 or less, the occurrence of image deletion is suppressed as compared with Examples 6 to 13 and 15 to 17.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for electrostatic image development comprising:

toner particles; and an external additive containing silica particles and polytetrafluoroethylene particles, the silica particles having a compression-aggregation degree of 60% or more and 95% or less and a particle compression ratio of 0.20 or more and 0.40 or less, wherein the silica particles are surface-treated with a siloxane compound having a viscosity of 1,000 cSt or more and 50,000 cSt or less, and the surface adhesion amount of the siloxane compound on the silica particles is 0.01% by mass or more and 5% by mass or less, and wherein the silica particles are surface-treated with the siloxane compound in an atmosphere of supercritical carbon dioxide in which the pressure of the supercritical carbon dioxide is from 8 MPa to 30 MPa.

2. The toner for electrostatic image development according to claim 1, wherein the average equivalent circle diameter of the silica particles is 40 nm or more and 200 nm or less.

3. The toner for electrostatic image development according to claim 1, wherein the particle dispersion degree of the silica particles is 90% or more and 100% or less.

4. The toner for electrostatic image development according to claim 1, wherein the content ratio (silica particles/polytetrafluoroethylene particles) of the silica particles to the polytetrafluoroethylene particles is 2.0 or more and 30.0 or less on a mass basis.

5. The toner for electrostatic image development according to claim 1, wherein the amount (content) of the silica particles externally added is 0.1% by mass or more and 6.0% by mass or less relative to the toner particles.

6. The toner for electrostatic image development according to claim 1, wherein the toner particles contain a polyester resin.

7. The toner for electrostatic image development according to claim 6, wherein the weight-average molecular weight (Mw) of the polyester resin is 5,000 or more and 1,000,000 or less.

8. The toner for electrostatic image development according to claim 6, wherein the number-average molecular weight (Mn) of the polyester resin is 2,000 or more and 100,000 or less.

9. The toner for electrostatic image development according to claim 6, wherein the molecular weight distribution Mw/Mn of the polyester resin is 1.5 or more and 100 or less.

10. The toner for electrostatic image development according to claim 6, wherein the content of the polyester resin is 40% by mass or more and 95% by mass or less relative to the toner particles.

11. The toner for electrostatic image development according to claim 1, wherein the toner particles contain 1% by mass or more and 30% by mass or less of a coloring agent.

12. The toner for electrostatic image development according to claim 1, wherein the toner particles contain 1% by mass or more and 20% by mass or less of a mold release agent.

13. The toner for electrostatic image development according to claim 12, wherein the melting temperature of the mold release agent is 50° C. or more and 110° C. or less.

14. The toner for electrostatic image development according to claim 1, wherein the volume-average particle diameter (D50v) of the toner particles is 2 μm or more and 10 μm or less.

15. The toner for electrostatic image development according to claim 1, wherein the average circularity of the toner particles is 0.95 or more and 1.00 or less.

16. The toner for electrostatic image development according to claim 1, wherein the siloxane compound is silicone oil.

17. An electrostatic image developer comprising the toner for electrostatic image development according to claim 1.

18. The electrostatic image developer according to claim 17, comprising a carrier coated with a resin containing carbon black.

19. A toner cartridge detachable from an image forming apparatus, the toner cartridge comprising the toner for electrostatic image development according to claim 1.

* * * * *